US006232266B1

(12) United States Patent
Masuda et al.

(10) Patent No.: US 6,232,266 B1
(45) Date of Patent: May 15, 2001

(54) HEAT-SENSITIVE RECORDING MATERIAL

(75) Inventors: Takao Masuda; Yasuro Yokota, both of Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 09/199,188

(22) Filed: Nov. 25, 1998

(30) Foreign Application Priority Data

| | | |
|---|---|---|
| Nov. 27, 1997 | (JP) | 9-326520 |
| Jan. 21, 1998 | (JP) | 10-009215 |
| Apr. 3, 1998 | (JP) | 10-091323 |
| Sep. 24, 1998 | (JP) | 10-326520 |

(51) Int. Cl.[7] ..... B41M 5/30

(52) U.S. Cl. ..... 503/200; 427/150; 503/204; 503/209

(58) Field of Search ..... 427/150–152; 503/200, 214, 215, 207, 204, 209

(56) References Cited

U.S. PATENT DOCUMENTS

| | | | | |
|---|---|---|---|---|
| 4,749,679 | | 6/1988 | Yoshida et al. | 503/208 |
| 4,760,048 | | 7/1988 | Kurihara et al. | 503/204 |
| 4,990,482 | * | 2/1991 | Nigorikaua et al. | 503/209 |
| 5,248,555 | | 9/1993 | Matsushita et al. | 428/402 |
| 5,354,724 | | 10/1994 | Hoffmann et al. | 503/209 |
| 5,804,528 | | 9/1998 | Aoki et al. | 503/204 |
| 5,977,019 | * | 11/1999 | Ozeki et al. | 503/204 |

FOREIGN PATENT DOCUMENTS

| | | |
|---|---|---|
| 6-155918A | 6/1994 | (JP) . |
| 7-031869A | 2/1995 | (JP) . |
| 8-282115A | 10/1996 | (JP) . |
| 9-142025A | 6/1997 | (JP) . |
| 9-263057A | 10/1997 | (JP) . |
| 9-290565A | 11/1997 | (JP) . |

* cited by examiner

*Primary Examiner*—Bruce H. Hess
(74) *Attorney, Agent, or Firm*—Pillsbury Winthrop LLP

(57) ABSTRACT

There is disclosed a heat-sensitive recording material having a support and provided thereon a heat-sensitive recording layer mainly comprising a heat-sensitive recording component which forms a color by heating, the improvement wherein the heat-sensitive recording component comprises two or more kinds of compounds, and at least one of the compounds constituting the heat-sensitive recording component is contained in the heat-sensitive recording layer in the state of a particle on the surface of which is formed a color-formation controlling layer obtained by polymerizing a compound having an unsaturated carbon bond.

52 Claims, No Drawings

HEAT-SENSITIVE RECORDING MATERIAL

BACKGROUND OF THE INVENTION

1. Field of the invention

This invention relates to a heat-sensitive recording material, more specifically to a heat-sensitive recording material containing a heat-sensitive recording component coloring characteristics such as a coloring temperature, etc. of which are controlled.

2. Prior art

A heat-sensitive material generally comprises a support and a heat-sensitive recording layer mainly comprising an electron-donative dye precursor generally colorless or pale colored and an electron-accepting developer as main component provided on the support. By heating the heat-sensitive material with a thermal head (heat head), a thermal pen, and a laser beam, etc., the dye precursor and the developer are immediately reacted to obtain a colored image. This is disclosed in, for example, Japanese Patent Publications No. 4160/1968 and No. 14039/1970, etc.

Recording by using such a heat-sensitive recording material can be carried out with a relatively simple device, and the device has advantages that maintenance is easy, no noise generates, etc. Thus, it is utilized in various fields such as an instrumental recorder, a facsimile machine, a printer, terminals of a computer, labeling, a ticket vending machine, etc.

On the other hand, in many uses of heat-sensitive recording materials, it has been desired to develop a multi-colored heat-sensitive recording material which can form two or more color tones by the difference of heating temperature. As a method for realizing such a multi-colored heat-sensitive recording material, the following methods have been known. One of them is a method in which color-forming temperatures are controlled by changing melting points of compounds constituting heat-sensitive recording components, and at low temperature heating, only a heat-sensitive recording component having a low color-forming temperature forms a color, while at a high temperature, the heat-sensitive recording component having a low color-forming temperature and a heat-sensitive recording component having a high color-forming temperature simultaneously produce colors to form a different color tone from that of the low-temperature heating as disclosed in Japanese Patent Publication No. 69/1974. As another method, several kinds of heat-sensitive recording components are contained in respective layers laminated on a support separately, and a heat-sensitive recording component contained in a surface layer which is close to a heat source is color-formed at a lower heating temperature, and a heat-sensitive recording component contained in a layer which is farthest from the heat source is color-formed at a higher heating temperature as disclosed in Japanese Patent Publication No. 27708/1974.

In the former method in which a color-forming temperature is controlled by changing a melting point of the compound constituting the heat-sensitive recording component, there are problems that raw materials which can be used in the method are limited and a balance with the other characteristics cannot sufficiently be obtained. In addition, to contain the heat-sensitive color-forming components different in a formed color tone in the same layer, it is necessary to prevent color formation by an interaction of the different kinds of heat-sensitive recording components to each other. Also, in the latter method in which respective kinds of heat-sensitive recording components are contained in a separate layer among the laminated layers, there is a problem that the layer constitution of the multi-colored heat-sensitive recording material becomes complex whereby productivity becomes worse, or the like.

Moreover, in the multi-colored heat-sensitive recording material, it is important that two kinds or more of color tones are formed within a narrow temperature range (a printing energy range), i.e., formed color tones are clearly separated to each other. To realize the above, it is required that, in a color-forming behavior of a high-temperature color-forming component, the difference between the highest temperature (the maximum energy) of a heating temperature (an applied energy) at which no color is formed and the lowest temperature (the minimum energy) at which color formation reaches saturation is small, that is, start of color-formation relative to the temperature (energy) is steep. By making start or raise of color formation of the high-temperature color-forming component steep, within a narrow temperature range (a printing energy range), the high-temperature color-forming component does not form a color at low-temperature heating but suddenly forms a color only at a certain temperature or more so that a color tone by low-temperature color-forming is sharp and color separation becomes clear.

However, in the above-mentioned conventional multi-colored heat-sensitive recording materials, start of color formation of the high-temperature color-forming component is generally gentle and color separation is unclear. Also, even if a color formation temperature of the high-temperature color-forming component is shifted to a higher temperature side by a certain means, whereas low-temperature color formation becomes sharp and color separation becomes clear with a certain extent, high energy is required for color-formation of the high-temperature color-forming component whereby it cannot be practically used. To solve these problems, it has been proposed a method of controlling color-forming characteristics such as a color-formation temperature, etc. by incorporating a compound constituting the heat-sensitive recording components into a microcapsule to have a role of a color-formation controlling layer to the wall of the microcapsule.

For example, in Japanese Provisional Patent Publication No. 282115/1996, it has been proposed a method in which a plural number of electron-donative dye precursors and electron-accepting compounds having different color tone to be color-formed are contained in the same layer, and at least one of said electron-donative dye precursors is contained in a microcapsule. According to this method, a color-forming temperature can be heightened by reacting the electron-donative dye precursor and the electron-accepting compound. Also, the electron-donative dye precursor incorporated into the microcapsule and the electron-donative dye precursor not incorporated therein are not interacted to each other so that two kinds or more of color tones to be color-formed can be obtained by one layer of the heat-sensitive recording layer.

Also, by incorporating a compound constituting the heat-sensitive recording component, e.g., an electron-donative dye precursor, in a microcapsule, in a heat-sensitive recording material having a heat-sensitive recording layer containing the microcapsule, control of color-forming characteristics such as a color-forming temperature can be realized. Moreover, even if an electron-donative dye precursor and an electron-accepting compound are used in combination, which cause background surface fogging when they are used in combination by not separating with each other, by separating the electron-donative dye precursor and the electron-accepting compound, a heat-sensitive recording material having good color-forming can be obtained without causing background fogging.

Moreover, even if a substance which color-forms a heat-sensitive recording material such as an organic solvent is attached to the heat-sensitive recording material, such an erroneous color-formation of the heat-sensitive recording material can be prevented by providing a characteristic of not dissolving a color-forming substance by an organic solvent, etc. to a color-formation controlling layer.

As a method for forming a color-formation controlling layer on the surface of the compound constituting the heat-sensitive recording components, various kinds of methods for making microcapsule can be applied to. Specific examples thereof may include the interfacial polymerization method, the coacervation method, the spray drying method, the emulsion evaporating solidification method, the emulsion cooling solidification method, etc. However, the compounds constituting the heat-sensitive recording components are usually solid materials. Thus, when the interfacial polymerization method is to be employed, there is a method in which the compounds constituting the heat-sensitive recording components are dissolved in a solvent, starting materials of a capsule wall are added thereto, the mixture is dispersed in a medium such as water, etc., and then, the solvent dissolving the color-forming component is evaporated and simultaneously the capsule membrane is polymerized. However, there are drawbacks that procedure is complicated and productivity is lowered. Also, when the coacervation method is employed, there are drawbacks that preparation conditions of microcapsules are extremely limited and characteristics of the formed capsule wall are also limited. When the spray drying method is employed, there are drawbacks that uniformity of the capsule membrane is poor, a particle size of the capsule likely becomes too large, and printing property when applied to a heat-sensitive recording material becomes bad. When the solution cure coating method is employed, there is a drawback that a particle size of the capsule likely becomes too large, etc. When the melt dispersion cooling method is employed, there are drawbacks that a melting point of the capsule membrane is limited to a relatively low melting point so that the characteristics of the formed capsule wall are also limited.

On the other hand, in Japanese Provisional Patent Publication No. 142025/1997 which corresponds to U.S. Pat. No. 5,804,528, it is proposed a method for obtaining a multi-colored heat-sensitive recording material by using an electron-donative dye precursor as a compound constituting the heat-sensitive recording component, controlling color-formation characteristics by making an electron-donative dye precursor as a complex particle with a polyurea or a polyurethane, and by adding said complex particles to a heat-sensitive recording material to obtain a multi-colored heat-sensitive recording material. According to this method, it is disclosed that lowering in sensitivity is little and color-formation due to pressure or friction is hardly occurred as compared with the method of utilizing the usual microcapsule.

However, according to this method, a large amount of the polyurea or the polyurethane is to be contained in order to coat completely the electron-donative dye precursor so that a sufficient sensitivity cannot be obtained. Also, there are drawbacks that a range capable of controlling color-formation characteristics is limited with a certain extent, and start of color-formation likely becomes gentle.

SUMMARY OF THE INVENTION

An object of the present invention is to provide a heat-sensitive recording material which can control color-forming characteristics such as a color-formation temperature, etc. of a heat-sensitive recording component by providing a color-formation controlling layer on the surface of a compound constituting the heat-sensitive recording component with good productivity and by controlling the characteristics of the color-formation controlling layer freely.

The above object can be accomplished by a heat-sensitive recording material having a support and provided thereon a heat-sensitive recording layer mainly comprising a heat-sensitive recording component which forms a color by heating, the improvement wherein said heat-sensitive recording component comprises two or more kinds of compounds, and at least one of the compounds constituting said heat-sensitive recording component is contained in the heat-sensitive recording layer in the state of a particle on the surface of which is formed a color-formation controlling layer of a polymer comprising a compound having an unsaturated carbon bond.

DESCRIPTION OF THE PREFERRED EMBODIMENTS

The present invention will be explained in detail below.

The compound having an unsaturated carbon bond to be used for forming the color-formation controlling layer of the present invention is a compound having at least either of a carbon-carbon double bond or a carbon-carbon triple bond in the compound as the unsaturated carbon bond, and capable of subjecting an addition polymerization by opening the unsaturated bond. As such a compound, there may be mentioned a vinyl compound, a vinylidene compound, a vinylene compound, a circular olefin compound and an acetylene compound.

The heat-sensitive recording component to be used in the heat-sensitive recording material of the present invention is constituted by two kinds or more of compounds. At least one of these compounds is contained in a heat-sensitive recording layer in the form of a particle in which a color-formation controlling layer is formed on the surface thereof. Also, two or more kinds of compounds may be contained in the heat-sensitive recording layer each in the form of particles in which a color-formation controlling layer is formed on the surfaces thereof.

It has heretofore been carried out to lower a color-forming temperature or to increase a color-forming sensitivity by adding a sensitizer for the purpose of controlling color-forming characteristics. However, it is difficult to control the color-forming characteristics so as to heighten a color-forming temperature or to lower a color-forming sensitivity. In the present invention, however, the color-forming characteristics can be controlled to the direction of heightening a color-forming temperature or lowering a color-forming sensitivity by providing a color-formation controlling layer on the surface of a particle of the compound constituting the heat-sensitive recording component.

The color-formation controlling layer to be formed on the surface of the compound constituting the heat-sensitive recording component according to the present invention can be obtained by polymerizing a compound having an unsaturated carbon bond. By forming the color-formation controlling layer by polymerizing the compound having an unsaturated carbon bond, productivity is good as compared with the case where the color-formation controlling layer is provided by the conventional preparation process of a microcapsule, and characteristics of the color-formation controlling layer can be freely controlled.

The color-formation controlling layer according to the present invention can be formed by adding a compound having an unsaturated carbon bond to a dispersion of particles of a compound constituting the heat-sensitive recording component, and after adding a polymerization initiator, heating depending on necessity whereby addition polymerization occurs from the unsaturated carbon bond of the compound having the unsaturated carbon bond as an active site to cover the particles of the compound constituting the heat-sensitive recording component.

The dispersion of the compound constituting the heat-sensitive recording component for providing the color-formation controlling layer can be obtained by a method in which the compound constituting the heat-sensitive recording component is dry ground and dispersed in a dispersion medium, a method in which the compound constituting the heat-sensitive recording component is included in a dispersion medium and wet ground, or the like. As a method of grinding, an optional method can be used. A particle size of the compound constituting the heat-sensitive recording component in the emulsion is preferably 0.1 $\mu$m or more to 20 $\mu$m or less. When the particle size is within the above range in the present invention, the color-formation controlling layer can be formed with good efficiency and it is also advantageous in the points that the dispersion can be easily prepared and printing property of the heat-sensitive recording material is good.

As a mixing state when the compound having an unsaturated carbon bond is added to the dispersion of the compound constituting the heat-sensitive recording component, various states can be considered. That is, almost all of the dispersion of the compound constituting the heat-sensitive recording component and the compound having an unsaturated carbon bond form separate phases by phase separation, and there may be mentioned a state in which an extremely minute amount of the compound having an unsaturated carbon bond is dissolved in the dispersion of the compound constituting the heat-sensitive recording component, a state in which the dispersion of the compound constituting the heat-sensitive recording component and the compound having an unsaturated carbon bond do never dissolved and completely phase-separated, a state in which almost all or whole part of the compound having an unsaturated carbon bond is completely dissolved in the dispersion or the like.

Among these states, a dispersion of the compound constituting the heat-sensitive recording component and almost all the compound having an unsaturated carbon bond form separate phases by phase-separation. However, it is particularly preferably used the state that a minute amount of the compound having an unsaturated carbon bond is dissolved in the dispersion of the compound constituting the heat-sensitive recording component for forming a color-formation controlling layer on the surface of the particles of the compound constituting the heat-sensitive recording component. The state in which the compound having an unsaturated carbon bond is dispersed in the dispersion and a minute amount thereof is dissolved therein is also included in the above.

When the compound having an unsaturated carbon bond is polymerized in the state that a dispersion of the compound constituting the heat-sensitive recording component and almost all the compound having an unsaturated carbon bond form separate phases by phase-separation and a minute amount of the compound having an unsaturated carbon bond is dissolved in the dispersion of the compound constituting the heat-sensitive recording component, a color-formation controlling layer which is uniform and dense, and excellent in various characteristics can be formed on the surface of a particle of the compound constituting the heat-sensitive recording component as compared with the case where the polymerization is carried out under the other conditions.

On the other hand, in the state where a dispersion of the compound constituting the heat-sensitive recording component and the compound having an unsaturated carbon bond are completely not dissolved and completely phase-separated, it is difficult to form a color-formation controlling layer on the surface of the particle of the compound constituting the heat-sensitive recording component so that it is not preferred. Also, in the state where a dispersion of the compound constituting the heat-sensitive recording component and almost all or whole of the compound having an unsaturated carbon bond are completely dissolved, it is possible to form a color-formation controlling layer on the surface of the particle of the compound constituting the heat-sensitive recording component, but setting of the polymerization conditions are difficult whereby it is not preferred.

Also, it is not preferred the state that a polymer obtained by addition polymerization of the compound having an unsaturated carbon bond dissolves and/or swells in the dispersion since the color-formation controlling layer is difficultly formed on the surface of a particle of the compound constituting the heat-sensitive recording component.

Whereas the compound having an unsaturated carbon bond is polymerized in the state that a dispersion of the compound constituting the heat-sensitive recording component and almost all the compound having an unsaturated carbon bond form separate phases by phase-separation, the state in which a minute amount of the compound having an unsaturated carbon bond is dissolved in the dispersion of the compound constituting the heat-sensitive recording component and the state that the polymer obtained by addition polymerization of the compound having an unsaturated carbon bond does not dissolve or swell in the dispersion can be realized as follows: That is, a kind of a dispersion medium which disperses the compound having an unsaturated carbon bond and a dispersion medium which disperses a particle of the compound constituting the heat-sensitive recording component, and a kind of the compound having an unsaturated carbon bond are optionally selected.

In the present invention, as a dispersion medium which disperses a particle of the compound constituting the heat-sensitive recording component, water or a mixed solution of an organic solvent compatible with water and water is preferably used. Examples of the organic solvent compatible with water may include methyl alcohol, ethyl alcohol, isopropyl alcohol, acetone, methyl ethyl ketone, ethylene glycol, etc., but it is not particularly limited so long as it has compatibility with water. Further, in the present invention, it is preferred that 50% by weight or more of the dispersion medium which disperses a particle of the compound constituting the heat-sensitive recording component based on the total weight is constituted by water. When 50% by weight or more of the dispersion medium based on the total weight is constituted by water, when forming a color-formation controlling layer is formed on the surface of the particle of the compound constituting the heat-sensitive recording component by addition polymerization of the compound having an unsaturated carbon bond, dispersed state of the particle of the compound constituting the heat-sensitive recording component is stable, coagulation between particles of the compound constituting the heat-sensitive recording component is hardly occurred and hindrance of forming the color-formation controlling layer due to coagulation is likely not occurred.

In general, a heat-sensitive recording material is prepared by coating a heat-sensitive recording component constituting a heat-sensitive recording layer on a support in the state of a coating solution, and dried. A main component of the solvent/the dispersion medium of the coating solution is usually water in the points of productivity and safety. The particles of the compound constituting the heat-sensitive recording component onto which the color-formation controlling layer is provided in the present invention are dispersed in a dispersion medium containing 50% by weight or more of water, and thus, when a heat-sensitive recording material containing said particles is to be prepared, the technique of preparing the conventional coating solution of the heat-sensitive recording material can be applied to as such whereby it is industrially advantageous in the point of productivity. When the particles of the compound constituting the heat-sensitive recording component to which the color-formation controlling layer is provided are dispersed in a dispersion medium containing less than 50% by weight of water based on the total weight, and the dispersion is added to a coating solution of a heat-sensitive recording material in which water is a solvent/dispersion medium, stability of the dispersion becomes poor and coagulation will likely be caused. Also, when said particles of the compound is once dried, and dispersed in water again, the procedure becomes more complicated, and the productivity becomes poor so that it is not preferred.

In the present invention, when the compound having an unsaturated carbon bond is added to the dispersion of the particles of the compound constituting the heat-sensitive recording component onto the surface of which is provided a color-formation controlling layer, said compound is preferably added in the state of an emulsion. When the compound having an unsaturated carbon bond is added to the dispersion of the particles of the compound constituting the heat-sensitive recording component, by dispersing the compound having an unsaturated carbon bond in a dispersion medium, the color-formation controlling layer can be provided on the surface of the particles of the compound constituting the heat-sensitive recording component with a little amount of the compound having an unsaturated carbon bond with good efficiency and color-formation characteristics such as a color-forming temperature, etc., of the heat-sensitive recording component can be controlled.

A dispersion medium of the emulsion of the compound having an unsaturated carbon bond and a dispersion medium of the dispersion of the particles of the compound constituting the heat-sensitive recording component to which the color-formation controlling layer is formed may be preferably the same or have compatibility with each other. That is, when the dispersion medium of the dispersion of the particles of the compound constituting the heat-sensitive recording component to which the color-formation controlling layer is formed is an aqueous system (as already shown above, 50% by weight or more of the total weight is preferably water), it is preferred that the dispersion medium of the emulsion of the compound having an unsaturated carbon bond is also an aqueous system. When the dispersion medium of the emulsion of the compound having an unsaturated carbon bond and the dispersion medium of the dispersion of the particles of the compound constituting the heat-sensitive recording component to which the color-formation controlling layer is formed are different from each other and do not compatible with each other, if the both components are mixed, coagulation occurs and a color-formation controlling layer cannot be provided on the surface of the particles of the compound constituting the heat-sensitive recording component so that it is not preferred.

A dispersed droplet of an emulsion of the compound having an unsaturated carbon bond preferably has a volume average particle size of 1 $\mu$m or more and 100 $\mu$m or less. If the average particle size of the dispersed particles of the compound having an unsaturated carbon bond is less than 1 $\mu$m, addition polymerization of the compound having an unsaturated carbon bond does not proceed on the surface of the particles of the compound constituting the heat-sensitive recording component but rather occurs in the dispersed droplets. To the contrary, if said particle size markedly exceeds 100 $\mu$m, even when polymerization proceeds in the dispersed droplets, formation of coarse particles and coagulation thereof will likely be induced. On the other hand, if the volume average particle size of said dispersed droplets is 1 $\mu$m or more and 100 $\mu$m or less, the color-formation controlling layer can be provided on the surface of the particles of the compound constituting the heat-sensitive recording component with a little amount of the compound having an unsaturated carbon bond with good efficiency. When the compound having an unsaturated carbon bond is to be dispersed, it is preferred to optionally add a dispersion stabilizer.

Moreover, in the present invention, when the compound having an unsaturated carbon bond is added to the dispersion of the particles of the compound constituting the heat-sensitive recording component to which the color-formation controlling layer is formed on the surface thereof, the compound having an unsaturated carbon bond is added by dividing into two or more portions whereby the color-formation controlling layer is provided on said particle surface with two or more times, the color-formation controlling layer becomes a dense and more uniform membrane. Thus, difference in characteristics such as a color-formation temperature, etc. between particles of the compound constituting the heat-sensitive recording component to which the color-formation controlling layer is provided becomes small so that when preparing a multi-colored heat-sensitive recording material is prepared, color separation becomes more clear and thus, it is preferred.

In the present invention, by changing the characteristics of the color-formation controlling layer, characteristics of the heat-sensitive recording material containing the heat-sensitive recording component to which the color-formation controlling layer is provided such as a color-formation temperature, solvent resistance, preservability, etc., can be also markedly changed. As a method for changing the characteristics of the color-formation controlling layer, it can be easily realized by changing the kind and amount of the compound having an unsaturated carbon bond.

The compound having an unsaturated carbon bond according to the present invention is a compound having at least one unsaturated carbon bond referred to in the present specification. By containing a compound having two or more of unsaturated carbon bonds and changing the content thereof, characteristics of the color-formation controlling layer can be freely changed.

A color-formation controlling layer formed by polymerizing a compound having one unsaturated carbon bond and a compound having two or more of unsaturated carbon bonds is improved in resistance to stimulation from outside such as heat or an organic solvent as compared with a color-formation controlling layer formed by polymerizing a compound without adding a compound having two or more of unsaturated carbon bonds due to the structure of the polymer forming the color-formation controlling layer.

Moreover, the color-formation controlling layer becomes a higher density cross-linking structure accompanied by increment of the content of the compound having two or more unsaturated carbon bonds, and heat resistant characteristics and solvent resistance thereof are improved. The content of the compound having two or more unsaturated carbon bonds is preferably 1% by weight or more to 70% by weight or less, more preferably 10 to 50% by weight, based on the total weight of the compound having an unsaturated carbon bond. Within the above range, color-forming characteristics such as a color-forming temperature, etc. of the heat-sensitive recording component in the heat-sensitive recording material can be freely controlled with a wide range. Moreover, a substance which color-forms the heat-sensitive recording material such as an organic solvent is attached to a non-printed portion, the portion is difficultly color-formed. Thus, a heat-sensitive recording material which has high color-forming density at the printed portion and is capable of uniform printing can be obtained.

The total weight of the compound having an unsaturated carbon bond is preferably 0.5% by weight or more to 1000% by weight or less based on the particles of the compound constituting the heat-sensitive recording component to which the color-formation controlling layer is provided. When the amount of the compound having an unsaturated carbon bond is 0.5% by weight or more to 1000% by weight or less based on the particles of the compound constituting the heat-sensitive recording component to which the color-formation controlling layer, a coating in which the function as a color-formation controlling layer is sufficient is possible. Also, polymerization easily proceeds and coagulation is difficultly caused at the time of polymerization, and a heat-sensitive recording material having a sufficient color-formation density can be obtained.

Examples of the compound having an unsaturated carbon bond according to the present invention may be mentioned styrene, α-methylstyrene, α-methoxystyrene, m-bromostyrene, m-chlorostyrene, o-bromostyrene, o-chlorostyrene, p-bromostyrene, p-chlorostyrene, p-methylstyrene, p-methoxystyrene, 2-vinylpyridine, isobutene, 3-methyl-1-butene, butyl vinyl ether, methyl vinyl ketone, nitroethylene, vinylidene cyanide, ethylene, propylene, vinyl chloride, vinyl acetate, acrolein, methyl acrolein, acrylamide, N-methylol acrylamide, N,N-dimethyl acrylamide, diacetone acrylamide, N-octadecyl acrylamide, ethyl α-acetoxyacrylate, ethyl α-chloroacrylate, methyl α-chloroacrylate, methyl α-cyanoacrylate, methyl α-phenylacrylate, benzyl acrylate, butyl acrylate, ethyl acrylate, 2-ethylhexyl acrylate, stearyl acrylate, lauryl acrylate, tridecyl acrylate, 2-hydroxyethyl acrylate, 2-hydroxypropyl acrylate, 2-methoxyethyl acrylate, 2-butoxyethyl acrylate, ethoxyethoxyethyl acrylate, methyltriglycol acrylate, cyclohexyl acrylate, tetrahydrofurfuryl acrylate, cyanoethyl acrylate, ferrocenylmethyl acrylate, glycidyl acrylate, heptafluorobutyl acrylate, methyl acrylate, octyl acrylate, methyltrifluoro acrylate, 2-chloroethyl acrylate, 2-nitrobutyl acrylate, acrylic acid, α-bromoacrylic acid, 2-hydroxyethylacryloyl phosphate, acrylonitrile, acryl glycidyl ether, allyl acetic acid, allyl alcohol, allyl benzene, N-allylstearylamide, 1-butene, 2-butene, N-vinyl-ε-caprolactam, ethyl N-vinylcarbamate, N-vinylcarbazole, crotonaldehyde, crotonic acid, 1,1-diphenylethylene, tetrafluoroethylene, diethyl fumarate, 1-hexene, 1-vinylimdazole, 1-vinyl-2-methylimidazole, indene, diethyl maleate, anhydrous maleate, maleimide, methacrylamide, benzyl methacrylate, ethyl methacrylate, ferrocenylmethyl methacrylate, glycidyl methacrylate, isopropyl methacrylate, propyl methacrylate, n-butyl methacrylate, isobutyl methacrylate, sec-butyl methacrylate, t-butylmethacrylate, 2-ethylhexylmethacrylate, cyclohexyl methacrylate, isodecyl methacrylate, lauryl methacrylate, tridecyl methacrylate, stearyl methacrylate, methyl methacrylate, phenyl methacrylate, 2-hydroxyethyl methacrylate, 2-hydroxypropyl methacrylate, 2-ethoxyethyl methacrylate, tetrahydrofurfuryl methacrylate, dimethylaminoethyl methacrylate, diethylaminoethyl methacrylate, 3-chloro-2-hydroxypropyl methacrylate, methacrylic acid, methacryloxyethyl phosphate, polyethyleneglycol monomethacrylate, polypropylene glycol monomethacrylate, N-methylol methacrylate, polypropylene glycol monomethacrylate, N-methylol methacrylamide, methacrylonitrile, methacryloyl acetone, 2-isopropenyl-2-oxazolidone, 2-vinylquinoline, vinyl benzoate, vinyl dodecyl ether, vinyl ethyl sulfoxide, vinyl formate, vinyl isobutyl ether, vinyl laurate, vinyl phenyl ether, acetylene, phenylacetylene, etc., but the present invention is not limited by these.

As the compound having two or more unsaturated carbon bonds mentioned above, there may be mentioned a compound having two or more carbon-carbon double bond and/or a carbon-carbon triple bond which is capable of addition polymerizing by opening the unsaturated carbon bond in the molecule. In view of the points that polymerizability is good, polymerization easily proceeds, and coagulation hardly occurs at the polymerization, etc., the compound represented by the following formulae (I), (II) or (III) or a polymerized material thereof (an oligomer) is preferably used.

(I)

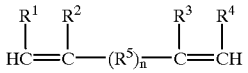

wherein n represents 0 or 1; $R^1$, $R^2$, $R^3$ and $R^4$ each represent a hydrogen atom, a halogen atom, an alkyl group, an alkoxycarbonyl group or an alkoxycarbonylmethyl group; and $R^5$ is a divalent group having a number of atoms of 50 or less other than the hydrogen atoms contained in $R^5$.

Specific examples of the compound represented by the formula (I) may include a polyethylene glycol diacrylate such as ethylene glycol diacrylate, diethylene glycol diacrylate, triethylene glycol diacrylate, tetraethylene glycol diacrylate, octaethylene glycol diacrylate, etc.; a polyethylene glycol dimethacrylate such as ethylene glycol dimethacrylate, diethylene glycol dimethacrylate, triethylene glycol dimethacrylate, tetraethylene glycol dimethacrylate, etc.; a 2,2-bis(4-acryloxypolyethoxyphenyl) propane such as 2,2-bis(4-acryloxyethoxyphenyl)propane, 2,2-bis(4-acryloxydiethoxyphenyl)propane, 2,2-bis(4-acryloxydiethoxyphenyl)propane, 2,2-bis(4-acryloxytriethoxyphenyl)propane, etc.; a 2,2-bis(4-methacrryloxypolyethoxphenyl)propane such as 2,2- bis(4-methacryloxyethoxyphenyl)propane, 2,2-bis(4-methacryloxydiethoxyphenyl)propane, 2,2-bis(4-methacryloxydiethoxyhenyl)propane, 2,2-bis(4-methacryloxytriethoxyphenyl)propane, etc.; allyl acrylate, 1,3-butanediol diacrylate, 1,4-butandiol diacrylate, 1,5-pentanediol diacrylate, neopentylglycol diacrylate, 1,6-hexanediol diacrylate, polypropylene glycol diacrylate, N,N'-methylenebisacrylamide, allyl methacrylate, 1,3-butanediol dimethacrylate, neopentylglycol dimethacrylate, 1,6-hexanediol dimethacrylate, dipropylene glycol dimethacrylate, diallyl phthalate, diallyl chlorendate, butadiene, ethyl butadiene-1-carboxylate, diethyl butadiene-1,4-dicarboxylate, diallyl melamine, diallyl phthalate, N,N-divinylaniline, divinyl ether, divinyl benzene, divinyl naphthalene, 1,3-butanediol dimethacrylate, isoprene, etc. but the present invention is not limited by these.

(II)

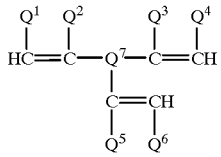

wherein $Q^1$, $Q^2$, $Q^3$, $Q^4$, $Q^5$ and $Q^6$ each represent a hydrogen atom, a halogen atom, an alkyl group, an alkoxycarbonyl group or an alkoxycarbonylmethyl group, and $Q^7$ represents a trivalent group having a number of atoms of 50 or less other than the hydrogen atoms contained in $Q^7$.

Specific examples of the compound represented by the formula (II) may include pentaerythritol triacrylate, trimethylolpropane triacrylate, trimethylolethane trimethacryalte, trimethylolpropane trimethacrylate, triallyl cyanurate, triallyl isocyanurate, triallyltrimellitate, etc. but the present invention is not limited by these.

(III)

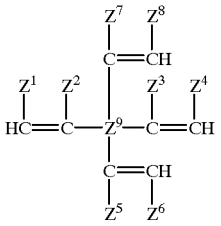

wherein $Z^1$, $Z^2$, $Z^3$, $Z^4$, $Z^5$, $Z^6$, $Z^7$ and $Z^8$ each represent a hydrogen atom, a halogen atom, an alkyl group, an alkoxycarbonyl group or an alkoxycarbonylmethyl group, and $Z^9$ represents a tetravalent group having a number of atoms of 50 or less other than the hydrogen atoms contained in $Z^9$.

Specific examples of the compound represented by the formula (III) may include tetramethylolmethane tetraacrylate, tetramethylolmethane tetramethacrylate, etc. but the present invention is not limited by these.

The compound having at least one unsaturated carbon bond according to the present invention as mentioned above may be used singly or in combination of two or more. When two or more kinds of the compounds are used in combination, it is preferred to use a compound having one unsaturated carbon bond and a compound having two or more unsaturated carbon bonds in combination (with a specific ratio) but two or more kinds of compounds each having one unsaturated carbon bond or two or more kinds of compounds each having two or more unsaturated carbon bonds may be used in combination. When the compound having two or more unsaturated carbon bonds is used as the compound having an unsaturated carbon bond, at least one compound selected from the group consisting of the compounds represented by the above formulae (I), (II) and (III), and a compound having two or more unsaturated carbon bond which is not included in the above formulae may be used. Or else, at least one of the compound represented by the above formulae (I), (II) and (III), and a compound having two or more unsaturated carbon bond which is not included in the above formulae may be used in combination.

Moreover, when the compound having an unsaturated carbon bond is added to a dispersion of particles of the compound constituting the heat-sensitive recording component to the surface of which is provided a color-formation controlling layer, if the compound having an unsaturated carbon bond is divided into two or more portions and added to the dispersion, and the color-formation controlling layer is formed on the particle surface by two or more times, the compound having an unsaturated carbon bond to be used for preparation of the color-formation controlling layer may be the same or different compound at the respective times and the compound is used in combination of two or more kinds, the kind of the compounds may be the same or different from each other at the respective times.

When a dispersion medium dispersing particles of the compound constituting the heat-sensitive recording component is constituted by 50% by weight or more of water based on the total weight of the dispersion, a part or whole of the compound having an unsaturated carbon bond is preferably a methacrylate such as benzyl methacrylate, ethyl methacrylate, ferrocenylmethyl methacrylate, glycidyl methacrylate, isopropyl methacrylate, propyl methacrylate, n-butyl methacrylate, isobutyl methacrylate, sec-butyl methacrylate, t-butyl methacrylate, 2-ethylhexyl methacrylate, cyclohexyl methacrylate, isodecyl methacrylate, lauryl methacrylate, tridecyl methacrylate, stearyl methacrylate, methyl methacrylate, phenyl methacrylate, 2-hydroxyethyl methacrylate, 2-hydroxypropyl methacrylate, 2-ethoxyethyl methacrylate, tetrahydrofurfuryl methacrylate, dimethylaminoethyl methacrylate, diethylaminoethyl methacrylate, 3-chloro-2-hydroxypropyl methacrylate, methacryloxyethyl phosphate, polyethylene glycol monomethacrylate, polypropylene glycol monomethacrylate, ethylene glycol dimethacrylate, diethylene glycol dimethacrylate, triethylene glycol dimethacrylate, tetraethylene glycol dimethacrylate, allyl methacrylate, 1,3-butanediol dimethacrylate, neopentylglycol dimethacrylate, 1,6-hexanediol dimethacrylate, dipropylene glycol dimethacrylate, 1,3-butanediol dimethacrylate, trimethylolethane trimethacrylate, trimethylolpropan trimethacrylate, tetramethylolmethane tetramethacrylate, etc.

When a part or whole of the compound having an unsaturated carbon bond is a methacrylate, the methacrylate and its polymerized material have good adhesive property with particles of the compound constituting the heat-sensitive recording component to which a color-formation controlling layer is formed, and solubility in an aqueous dispersion medium is suitable and polymerizability is good so that it is possible to effectively coat the surface of the particles of the compound constituting the heat-sensitive recording component by addition polymerization. Moreover, it is excellent in the function of controlling color-forming characteristics such as a color-formation temperature, etc., and particularly a multi-colored heat-sensitive recording material excellent in color separation can be obtained.

As a polymerization initiator to be added to initiate addition polymerization of the compound having an unsaturated carbon bond, those known in the art may be used. The manner of the polymerization reaction is not particularly limited such as a radical polymerization, anion polymerization, cation polymerization, etc., but a radical polymerization is particularly preferably used. At the time of the polymerization, the reaction system may be heated depending on necessity. Specific examples of the polymerization initiator of the radical polymerization are include, for example, a peroxide such as hydrogen peroxide, cumene hydroperoxide, t-butyl hydroperoxide, dicumylperoxide, di-t-butyilperoxide, benzoylperoxide, lauroyl peroxide, etc.; a persulfate such as potassium persulfate, ammonium persulfate, etc.; an azo compound such as 2,2'-azobisisobutyronitrile, 2,2'-azobis(2,4-dimethylvaleronitrile), 2,2'-azobis(2-methylpropionamidine)dihydrochloride, 4,4'-azobis(4-cyanovaleric acid), etc.; a redox initiator such as a combination of hydrogen peroxide and a ferrous salt, a combination of a persulfate and acidic sodium sulfite, a combination of cumene hydroperoxide and a ferrous salt, a combination of benzoyl peroxide and diethylaniline, a combination of a peroxide and an alkyl metal, a combination of oxygen and an organic metal alkyl, etc.

These catalysts may be used singly or in admixture. Also, when the color-formation controlling layer is formed by dividing into two or more times on the surface of the particles of the compound constituting the heat-sensitive recording component, a polymerization initiator to be added to effect addition polymerization of the compound having an unsaturated carbon bond two times or more may be added once or dividing into two or more. Also, when the polymerization initiator is added by dividing into two or more times, the polymerization initiator may be a single compound or a mixture of two or more compounds and the respective polymerization initiators to be added by two or more times may be the same or different from each other.

The polymerization initiator of a radical polymerization is not particularly limited only to the above so long as it occurs an active radical by an energy of heat or light. When the dispersion medium which disperses particles of the compound constituting the heat-sensitive recording component is composed of 50% by weight or more of water, it is particularly preferred to use a water-soluble polymerization initiator such as potassium persulfate, ammonium persulfate, 2,2'-azobis-(2-methylpropionamidine)dihydro chloride, etc. When the water-soluble polymerization initiator is used, a polymerization initiating terminal of the polymer obtained by polymerizing the compound having an unsaturated carbon bond is made hydrophilic so that the polymer itself has a dispersion stability. Thus, coagulation between particles at the time of polymerization of the particles of the compound constituting the heat-sensitive recording component is inhibited whereby a dispersion of the particles of the compound constituting the heat-sensitive recording component to which a more stable color-forming controlling layer can be obtained.

As other method for introducing a hydrophilic group in the molecule of the polymer for forming the color-formation controlling layer, it is possible to contain a water-soluble compound to a part of the compound having an unsaturated carbon bond. According to this method, it is also possible to obtain a dispersion of particles of the compound constituting the heat-sensitive recording component to which a more stable color-formation controlling layer.

As for an amount of the polymerization initiator to be added, it is not particularly limited so long as it is an amount that the compound having an unsaturated carbon bond initiates addition polymerization. In order to effectively initiates the addition polymerization, it is preferably 0.001% by weight or more to 10% by weight or less based on the compound having an unsaturated carbon bond. Also, when the compound having an unsaturated carbon bond is subjected to addition polymerization two times or more, an amount of the polymerization initiator based on the compound having an unsaturated bond may be the same of different.

A dispersion of the compound constituting the heat-sensitive recording component to be used in the present invention can be obtained by a method in which the compound constituting the heat-sensitive recording component is dry ground and dispersed in a dispersion medium, a method in which the compound constituting the heat-sensitive recording component is mixed in a dispersion medium and wet ground, etc. As a method of grinding the compound, optional method may be used. A particle size of the compound constituting the heat-sensitive recording component in the dispersion is preferably 20 $\mu$m or less. If the particle size is larger than the above, uniform printing is hardly carried out so that it is not preferred. The particle size is particularly preferably 10 $\mu$m or less which gives more uniform printing. Also, the lower limit of the particle size of said compound is not particularly limited, but it is preferably 0.1 $\mu$m or more in the point of easiness in manufacture. Also, when the compound constituting the heat-sensitive recording component is dispersed, a dispersion medium which is suitable for the dispersion medium of said dispersion may be used depending on necessity.

The heat-sensitive recording component to be used in the present invention is not particularly limited, but there may be mentioned a combination of a usually colorless or pale colored electron-donative dye precursor and an electron-accepting compound, a combination of an isocyanate compound and an imino compound, a combination of a usually colorless or pale colored electron-donative dye precursor and an isocyanate compound, a combination of a metal compound and a coordinated compound, a combination of a diazonium salt and a coupler, etc. In the points of a color density, easiness in color-formation, easiness in controlling of color-formation, etc., a combination of a usually colorless or pale colored electron-donative dye precursor and an electron-accepting compound, a combination of an isocyanate compound and an imino compound, and a combination of a usually colorless or pale colored electron-donative dye precursor and an isocyanate compound are preferably used. Also, when an isocyanate compound is used, a heat-sensitive recording material particularly excellent in image stability can be obtained.

As the usually colorless or pale colored electron-donative dye precursor, a compound generally used in a pressure-sensitive recording paper, a heat-sensitive recording paper, etc. may be used and is not particularly limited. Specific examples thereof may include those as mentioned below but the present invention is not limited by these.

Triarylmethane series compounds such as 3,3-bis(p-dimethylaminophenyl)-6-dimethylaminophthalide (Crystal violet lactone), 3,3-bis(p-dimethylaminophenyl)phthalide, 3-(p-dimethylaminophenyl-3-(1,2-dimethylindol-3-yl) phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-(p-dimethylaminophenyl)-3-(1-methylpyrrol-2-yl)-6-dimethylaminophthalide, etc.; diphenylmethane series compounds such as 4,4'-bis (dimethylaminophenyl)benzhydryl benzyl ether, N-chlorophenylleucoauramine, N-2,4,5-trichlorophenylleucoauramine, etc.; xanthene series compounds such as Rhodamine B anilinolactam, Rhodamine B-p-chloroanilinolactam, 3-diethylamino-7-dibenzylaminofluorane, 3-diethylamino-7-octylaminofluorane, 3-diethylamino-7-phenylfluorane, 3-diethylamino-7-chlorofluorane, 3-diethnylamino-6-chloro-7-methylfluorane, 3-diethylamino-7-(3,4-dichloroanilino)fluorane, 3-diethylamino-7-(2-chloroanilino)fluorane, 3-diethylamino-6-methyl-7-anilinofluorane, 3-(N-ethyl-N-tolyl)amino-6-methyl-7-anilinofluorane, 3-piperidino-6-methyl-7-anilinofluorane, 3-(N-ethyl-N-tolyl)amino-6-methyl-7-phenethylfluorane, 3-diethylamino-7-(4-nitroanilino)fluorane, 3-dibutylamino-6-methyl-7-anilinofluorane, 3-(N-methyl-N-propyl)amino-6-methyl-7-anilinofluorane, 3-(N-ethyl-N-isoamyl)amino-6-methyl-7-anilinofluorane, 3-(N-methyl-N-cyclohexyl) amino-6-methyl-7-anilinofluorane, 3-(N-ethyl-N-tetrahydrofuryl)amino-6-methyl-7-anilinofluorane, etc.; thiazine series compounds such as benzoylleucomethylene blue, p-nitrobenzoylleucomethylene blue, etc.; spiro series compounds such as 3-methylspirodinaphthopyran, 3-ethylspirodinaphthopyran, 3,3'-dichlorospirodinaphthopyran, 3-benzylspirodinaphthopyran, 3-methylnaphtho-(3-methoxybenzo)spiropyran, 3-propylspirodinaphthopyran, etc. These compounds may be used alone or in combination of two or more compounds.

Specific examples of the electron-accepting compound which color-forms by reacting with these usually colorless or pale colored electron-donative dye precursors may include those as mentioned below but the present invention is not limited by these. There may be mentioned p-phenylphenol, p-hydroxyacetophenone, 4-hydroxy-41-methyldiphenyl sulfone, 4-hydroxy-4'-isopropoxydiphenyl sulfone, 4-hydroxy-4'-benzenesulfonyloxydiphenyl sulfone, 1,1-bis(4-hydroxyphenyl)propane, 1,1-bis(4-hydroxyphenyl)propane, 1,1-bis(4-hydroxyphenyl)pentane, 1,1-bis(4-hydroxyphenyl)hexane, 1,1-bis(4-hydroxyphenyl) cyclohexane, 1,1-bis(4-hydroxyphenyl)cyclododecane, 2,2-bis(4-hydroxyphenyl)propane, 2,2-bis(4-hydroxyphenyl) hexane, 2,2-bis(4-hydroxyphenyl)octane, 1,1-bis(4-hydroxyphenyl)-2-ethylhexane, 2,2-bis(3-chloro-4-hydroxyphenyl)propane, 1,1-bis(4-hydroxyphenyl)-1-phenylethane, 1,3-bis(2-(4-hydroxyphenyl)-2-propyl) benzene, 1,3-bis(2-(3,4-dihydroxyphenyl)-2-propyl) benzene, 1,4-bis(2-(4-hydroxyphenyl)-2-propyl)benzene, 4,4'-dihydroxydiphenyl ether, 4,4'-dihydroxydiphenyl sulfone, 2,4'-dihydroxydiphenyl sulfone, 3,3'-dichloro-4,4'-dihydroxydiphenyl sulfone, 3,3'-dichlorodiallyl-4,41-dihydroxydiphenyl sulfone, 3,3'-dichloro-4,4'-dihydroxydiphenyl sulfide, methyl 2,2-bis(4-hydroxyphenyl)acetate, butyl 2,2-bis(4-hydroxyphenyl) acetate, 4,41-thio-bis(2-t-butyl-5-methylphenol), benzyl p-hydroxybenzoate, dimethyl 4-hydroxyphthalate, benzyl gallate, stearyl gallate, salicylanilide, 5-chlorosalicylanilide, etc. These compounds may be used alone or in combination of two or more compounds.

Specific examples of the isocyanate compound which color-forms by reacting with the usually colorless or pale colored electron-donative dye precursor or the imino compound may include a colorless or pale colored isocyanate compound which is a solid at normal temperature or a heterocyclic isocyanate compound, etc., and at least one of the following may be used. There may be mentioned 1,1,4,6-tetramethylindane-5,7-diisocyanate, 2,6-dichlorophenylisocyanate, p-chlorophenylisocyanate, 1,3-phenylenediisocyanate, 1,4-phenylenediisocyanate, 1,3-dimethylbenzene-4,6-diisocyanate, 1,4-dimethylbenzene-2,5-diisocyanate, 1-methoxybenzene-2,4-diisocyanate, 1-methoxybenzene-2,5-diisocyanate, 1-ethoxybenzene-2,4-diisocyanate, 2,5-dimethoxybenzene-1,4-diisocyanate, 2,5-diethoxybenzene-1,4-diisocyanate, 2,5-dibutoxybenzene-1,4-diisocyanate, azobenzene-4,4'-diisocyanate, diphenylether-4,4'-diisocyanate, naphthalene-1,4-diisocyanate, naphthalene-1,5-diisocyanate, naphthalene-2,6-diisocyanate, naphthalene-2,7-diisocyanate, 3,3'-dimethylbiphenyl-4,4'-diisocyanate, 3,3'-dimethoxybiphenyl-4,4'-diisocyanate, diphenylmethane-4,4'-diisocyanate, diphenyldimethylmethane-4,4'-diisocyanate, benzophenone-3,3'-diisocyanate, fluorene-2,7-diisocyanate, anthraquinone-2,6-diisocyanate, 9-ethylcarbazole-3,6-diisocyanate, pyrene-3,8-diisocyanate, naphthalene-1,3,7-triisocyanate, bipheyl-2,4,4'-triisocyanate, 4,4,4', 4"-triisocyanato-2,5-dimethoxytriphenylamine, p-dimethylaminophenylisocyanate, tris(4-phenylisocyanate) thiophosphate, etc. These isocyanate compounds may be used in the form of the so-called block isocyanate, which is an adduct compound with a phenol derivative, a lactam derivative, an oxime derivative, etc. depending on necessity, or may be used in the form of a dimer of the diisocyanate, e.g., a dimer of 1-methylbenzene-2,4-diisocyanate, and in the form of an isocyanurate which is a trimer. Also, it is possible to use the compound as a polyisocyanate which is made an adduct by using various kinds of polyols.

Specific examples of the imino compound may include those as mentioned below but the present invention is not limited by these.

There may be mentioned 3-iminoisoindolin-1-one, 3-imino-4,5,6,7-tetrachloroisoindolin-1-one, 3-imino-4,5,6,7-tetrabromoisoindolin-1-one, 3-imino-4,5,6,7-tetrafluoroisoindolin-1-one, 3-imino-5,6-dichloroisoindolin-1-one, 3 -imino-4,5,7-trichloro-6-methoxyisoindolin-1-one, 3-imino-4,5,7-trichloro-6-methylmercapto-isoindolin-1-one, 3-imino-6-nitroisoindolin-1-one, 3-iminoisoindolin-1-spirodioxorane, 1,1-dimethoxy-3-iminoisoindoline, 1,1-diethoxy-3-imino-4,5,6,7-tetrachloroisoindoline, 1-ethoxy-3-iminoisoindoline, 1,3-diiminoisoindoline, 1,3-diiminoisoindoline, 1,3-diimino-4,5,6,7-tetrachloroisoindoline, 1,3-diimino-6-methoxyisoindoline, 1,3-diimino-6-cyanoisoindoline, 1,3-diimino-4,7-dithia-5,5,6,6-tetrahydroisoindoline, 7-amino-2,3-dimethyl-5-oxopyrolo[3,4b]pyrazine, 7-amino-2,3-diphenyl-5-oxopyrolo[3,4b]pyrazine, 1-iminonaphthalic acid imide, 1-iminodiphenic acid imide, 1-phenylimino-3-iminoisoindoline, 1-(3'-chlorophenylimino)-3-iminoisoindoline, 1-(2',5'-dichlorophenylimino)-3-iminoisoindoline, 1-(2',4',5'-trichlorophenylimino)-3-iminoisoindoline, 1-(2'-cyano-4'-nitrophenylimino)-3-iminoisoindoline, 1-(2'-chloro-5'-cyanophenylimino)-3-iminoisoindoline, 1-(2',6'-dichloro-4'-nitrophenylimino)-3-iminoisoindoline, 1-(2',5'-dimnethoxyphenylimino)-3-iminoisoindoline, 1-(21,51-diethoxyphenylimino)-3-iminoisoindoline, 1-(2'-methyl-4'-nitrophenylimino)-3-iminoisoindoline, 1-(5'-chloro-2'-phenoxyphenylimino)-3-iminoisoindoline, 1-(4'-N,N-dimethylaminophenylimino)-3-iminoisoindoline, 1-(3'-N,N-dimethylamino-4'-methoxyphenylimino)-3-iminoisoindoline, 1-(2'-methoxy-5'-N-phenylcarbamoylphenylimino)-3-iminoisoindoline, 1-(2'-chloro-51-trifluoromethylphenylimino)-3-iminoisoindoline, 1-(5',6'-dichlorobenzothiazolyl-2'-imino)-3-iminoisoindoline, 1-(6'-methylbenzothiazolyl-2'-imino)-

3-iminoisoindoline, 1-(41-phenylaminophenylimino)-3-iminoisoindoline, 1-(p-phenylazophenylimino)-3-iminoisoindoline, 1-(naphthyl-1'-imino)-3-iminoisoindoline, 1-(anthraquinon-1'-imino)-3-iminoisoindoline, 1-(5'-chloroanthraquinon-1'-imino)-3-iminoisoindoline, 1-(N-ethylcarbazolyl-3'-imino)-3-iminoisoindoline, 1-(naphthoquinon-1'-imino)-3-iminoisoindoline, 1-(pyridyl-4'-imino)-3-iminoisoindoline, 1-(benzimidazolon-6'-imino)-3-iminoisoindoline, 1-(1'-methylbenzimidazolon- 6'-imino)-3-iminoisoindoline, 1-(7'-chlorobenzimidazolon-6'-imino)-3-iminoisoindoline, 1-(benzimidazolyl-2'-imino)-3-iminoisoindoline, 1-(benzimidazolyl-2'-imino)-3-imino-4,5,6,7-tetrachloroisoindoline, 1-(2',4'-dinitrophenylhydrazon)-3-iminoisoindoline, 1-(indazolyl-3'-imino)-3-iminoisoindoline, 1-(indazolyl-3'-imino)-3-imino-4,5,6,7-tetrabromoisoindoline, 1-(indazolyl-3'-imino)-3-imino-4,5,6,7-tetrafluoroisoindoline, 1-(benzimidazolyl-2'-imino)-3-imino-4,7-dithiatetrahydroisoindoline, 1-(4',5'-dicyanoimidazolyl-2'-imino)-3-imino-5,6-dimethyl-4,7-pyraziisoindoline, 1-(cyanobenzoylmethylene)-3-iminoisoindoline, 1-(cyanocarbonamidomethylene)-3-iminoisoindoline, 1-(cyanocarbomethoxymethylene)-3-iminoisoindoline, 1-(cyanocarboethoxymethylene)-3-iminoisoindoline, 1-(cyano-N-phenylcarbamoylmethylene)-3-iminoisoindoline, 1-(cyano-N-(3'-methylphenyl) carbamoylmethylene)-3-iminoisoindoline, 1-(cyano-N-(4'-chlorophenyl)carbamoylmethylene)-3-iminoisoindoline, 1-(cyano-N-(4'-methoxyphenyl)carbamoylmethylene)-3-iminoisoindoline, 1-(cyano-N-(3'-chloro-4'-methylphenyl) carbamoylmethylene)-3-iminoisoindoline, 1-(cyano-p-nitrophenylmethylene)-3-iminoisoindoline, 1-(dicyanomethylene)-3-iminoisoindoline, 1-(cyano-1',2',4'-triazolyl-(3')carbamoylmethylene)-3-iminoisoindoline, 1-(cyanothiazoyl-(2')-carbamoylmethylene)-3-iminoisoindoline, 1-(cyanobenzimidazolyl-(2')-carbamoylmethylene)-3-iminoisoindoline, 1-(cyanobenzothiazolyl-(2')-carbamoylmethylene)-3-iminoisoindoline, 1-((cyanobenzimidazolyl-2')-methylene)-3-iminoisoindoline, 1-((cyanobenzimidazolyl-2')-methylene)-3-imino-4,5,6,7-tetrachloroisoindoline, 1-((cyanobenzimidazolyl-2')-methylene)-3-imino-5-methoxyisoindoline, 1-((cyanobenzimidazolyl-2')-methylene)-3-imino-6-chloroisoindoline, 1-((1'-phenyl-3'-methyl-5-oxo)-pyrazoliden-4')-3-iminoisoindoline, 1-((cyanobenzimidazolyl-2')methylene)-3-imino-4,7-dithiatetrahydroisoindoline, 1-((cyanobenzimidazolyl-2')-methylene)-3-imino-5,6-dimethyl-4,7-pyraziisoindoline, 1-((1'-methyl-3'-n-butyl)-barbituric acid-5')-3-iminoisoindoline, 3-imino-1-sulfobenzoic acid imide, 3-imino-1-sulfo-6-chlorobenzoic acid imide, 3-imino-1-sulfo-5,6-dichlorobenzoic acid imide, 3-imino-1-sulfo-4,5,6,7-tetrachlorobenzoic acid imide, 3-imino-1-sulfo-4,5,6,7-tetrabromobenzoic acid imide, 3-imino-1-sulfo-4,5,6,7-tetrafluorobenzoic acid imide, 3-imino-1-sulfo-6-nitrobenzoic acid imide, 3-imino-1-sulfo-6-methoxybenzoic acid imide, 3-imino-1-sulfo-4,5,7-trichloro-6-methylmercaptobenzoic acid imide, 3-imino-1-sulfonaphthoic acid imide, 3-imino-1-sulfo-5-bromonaphthoic acid imide, 3-imino-2-methyl-4,5,6,7-tetrachloroisoindolin-1-one, etc. These compounds may be used alone or in combination of two or more compounds.

Among two or more kinds of compounds constituting the heat-sensitive recording component, the kind of the compound to form a color-formation controlling layer on the surface is not particularly limited. The color-formation controlling layer may be formed on any of the compounds constituting the heat-sensitive recording component such as an electron-donative dye precursor, an electron-accepting compound, an isocyanate compound, an imino compound, a metal compound, a coordinated compound, a diazonium salt, a coupler and the like.

When the heat-sensitive recording material of the present invention is applied to a multi-colored heat-sensitive recording material, it is particularly preferred to form a color-formation controlling layer on the surface of a compound which determines a color tone of the formed color among the compounds constituting the heat-sensitive recording component since a plural number of heat-sensitive recording components can be contained in the same layer. For example, when two kinds of heat-sensitive recording components in which an electron-donative dye precursor and an electron-accepting compound are combined are used as the heat-sensitive recording component, color tone of the formed color is substantially controlled by the electron-donative dye precursor. Accordingly, the electron-accepting compounds are made common in both of the heat-sensitive recording components, the color-formation controlling layer is formed on the surface of the particles of one of the electron-donative dye precursor, and the resulting electron-donative dye precursor is contained in the same layer with another electron-donative dye precursor and the electron-accepting compound whereby a multi-colored heat-sensitive recording material which color-forms two kinds of color tones due to the difference of a heating temperature can be obtained.

That is, by heating the material at a lower temperature, a first heat-sensitive recording component constituted by the electron-donative dye precursor on the surface of which is formed no color-formation controlling layer and the electron-accepting compound form a color to give a first color tone. Then, by heating the same at a higher temperature, both of the first heat-sensitive recording component and a second heat-sensitive recording component constituted by the electron-donative dye precursor on the surface of which is formed a color-formation controlling layer and the electron-accepting compound form colors to give a second color tone. A multi-colored heat-sensitive recording material containing three kinds of heat-sensitive recording components can be constituted similarly by a single layer. In this case, a plural kinds of color-formation controlling layers different in characteristics are formed on the respective surface of the electron-donative dye precursors constituting a plural kinds of heat-sensitive recording components, and the color-formation temperatures with regard to the respective heat-sensitive recording components are controlled to differentiate from each other.

The heat-sensitive recording material of the present invention can be applied to, in addition to the multi-colored heat-sensitive recording material, a heat-sensitive recording material in which a non-printed portion hardly forms a color under a high temperature condition, and a heat-sensitive recording material in which a non-printed portion hardly forms a color even when a substance which color-forms the heat-sensitive recording material such as an organic solvent is attached to a non-printed portion.

The heat-sensitive recording layer of the heat-sensitive recording material of the present invention can be formed by providing a heat-sensitive recording component on a support. The method of forming the heat-sensitive recording component on the surface is not particularly limited, but a method of coating a coating solution of the heat-sensitive recording material, a method of printing an ink containing the heat-sensitive recording material are preferred. Also, in the heat-sensitive recording layer, a binder may be used in combination depending on necessity. The binder to be contained in the heat-sensitive recording layer is not particularly limited, but a material which causes a less effect to the color-forming characteristics of the heat-sensitive recording component is particularly preferably used.

Specific examples of the binder may include, for example, a starch, hydroxyethyl cellulose, methyl cellulose, ethyl cellulose, carboxymethyl cellulose, gelatin, casein, polyvinyl alcohol, modified polyvinyl alcohol, polyacrylic acid, polymethacrylic acid, polyacrylate, polymethacrylate, sodium polyacrylate, polyethylene terephthalate, polybutyrene terephthalate, chlorinated polyether, an allyl resin, a furan resin, a ketone resin, oxybenzoyl polyester, polyacetal, polyether ether ketone, polyether sulfone, polyimide, polyamide, polyamidoimide, polyaminobismaleimide, polymethylpentene, polyphenylene oxide, polyphenylene sulfide, polyphenylene sulfone, polysulfone, polyallylate, polyallyl sulfone, polybutadiene, polycarbonate, polyethylene, polypropylene, polystyrene, polyvinyl chloride, polyvinylidene chloride, polyvinyl acetate, polyurethane, a phenol resin, a urea resin, a melamine resin, a melamine-formalin resin, a benzoguanamine resin, a bismaleimido-triazine resin, an alkyd resin, an amino resin, an epoxy resin, an unsaturated polyester resin, a styrene/butadiene copolymer, an acrylonitrile/butadiene copolymer, a methyl acrylate/buadiene copolymer, an ethylene/vinyl acetate copolymer, an acrylamide/acrylate copolymer, an acrylic amide/acrylate/methacrylic acid terpolymer, an alkali salt of a styrene/maleic anhydride copolymer, an alkali salt or an ammonium salt of an ethylene/maleic anhydride copolymer, other various kinds of polyolefin series resins, etc. These binders may be used alone or in combination of two or more.

A support to be formed thereon the heat-sensitive recording layer according to the present invention may be any of transparent, semi-transparent or opaque, and a paper, various kinds of nonwoven fabrics, woven fabrics, synthetic resin films, synthetic resin laminated papers, synthetic papers, metal foils, ceramic papers, glass plates, etc. or a composite sheet using at least two of the above in combination may be used optionally depending on the purposes.

In the heat-sensitive recording material of the present invention, at least one of a protective layer may be formed directly on the heat-sensitive recording layer or through other layer(s). The component of the protective layer is not particularly limited, but a material which gives less effect to the color-forming characteristics of the heat-sensitive recording composition is particularly preferably used.

Specific examples of the resin to be used for forming the protective layer may include a starch, hydroxyethyl cellulose, methyl cellulose, ethyl cellulose, carboxymethyl cellulose, gelatin, casein, polyvinyl alcohol, modified polyvinyl alcohol, polyacrylic acid, polymethacrylic acid, polyacrylate, polymethacrylate, sodium polyacrylate, polyethylene terephthalate, polybutyrene terephthalate, chlorinated polyether, an allyl resin, a furan resin, a ketone resin, oxybenzoyl polyester, polyacetal, polyether ether ketone, polyether sulfone, polyimide, polyamide, polyamidoimide, polyaminobismaleimide, polymethylpentene, polyphenylene oxide, polyphenylene sulfide, polyphenylene sulfone, polysulfone, polyallylate, polyallyl sulfone, polybutadiene, polycarbonate, polyethylene, polypropylene, polystyrene, polyvinyl chloride, polyvinylidene chloride, polyvinyl acetate, polyurethane, a phenol resin, a urea resin, a melamine resin, a melamine-formalin resin, a benzoguanamine resin, a bismaleimido-triazine resin, an alkyd resin, an amino resin, an epoxy resin, an unsaturated polyester resin, a styrene/butadiene copolymer, an acrylonitrile/butadiene copolymer, a methyl acrylate/ buadiene copolymer, an ethylene/vinyl acetate copolymer, an acrylamide/acrylate copolymer, an acrylic amide/acrylate/methacrylic acid terpolymer, an alkali salt of a styrene/maleic anhydride copolymer, an alkali salt or an ammonium salt of an ethylene/maleic anhydride copolymer, other various kinds of polyolefin series resins, etc. These binders may be used alone or in combination of two or more.

In the heat-sensitive recording material of the present invention, an intermediate layer may be provided between the heat-sensitive recording layer and the support in order to improve smoothness, heat insulating property, etc. In the intermediate layer, various kinds of resins, organic pigments, inorganic pigments, various kinds of hollow particles may be contained.

In the heat-sensitive recording material of the present invention, a recording layer containing a material in which information is electrically, magnetically or optically recordable therein between the heat-sensitive recording layer and the support and/or on the side at which the heat-sensitive recording layer is provided of the support, or an opposite side thereof may be provided. Also, a back coating layer may be provided on the side at which the heat-sensitive recording layer is provided of the support, or an opposite side thereof may be provided in order to prevent curl or for antistatic. Moreover, an adhesive property may be provided to the heat-sensitive recording material. Furthermore, on the surface of the heat-sensitive recording layer or the protective layer, printing by a UV ink may be carried out.

In the heat-sensitive recording material of the present invention, a light-heat exchanging material may be contained in an optional layer among the heat-sensitive recording materials and the support in order to carry out printing by a laser beam.

In an optional layer of the heat-sensitive recording material of the present invention, an inorganic or organic pigment such as diatomaceous earth, talc, kaolin, baked kaolin, calcium carbonate, magnesium carbonate, titanium oxide, zinc oxide, silicon oxide, aluminum hydroxide, a urea-formalin resin, etc.; and as others, a higher fatty acid metal salt such as zinc stearate, calcium stearate, etc.; a wax such as paraffin, oxidized paraffin, polyethylene, oxidized polyethylene, stearic amide, castor wax, etc.; a dispersion medium such as sodium dioctylsulfosuccinate, etc. ; and further a surfactant, a fluorescent dye, etc. may be contained.

Also, in order to improve light-resistance, an antioxidant, an ultraviolet-ray absorber, etc. may be added to the heat-sensitive recording material of the present invention. As the antioxidant, there may be mentioned a hindered amine type antioxidant, a hindered phenol type antioxidant, a sulfide type antioxidant, etc. Also, as the ultraviolet-ray absorber, there may be mentioned an organic type ultraviolet-ray absorber ultraviolet-ray absorber, a benzophenone type ultraviolet-ray absorber, etc., and an inorganic type ultraviolet-ray absorber such as zinc oxide, titanium oxide, cerium oxide, etc.

EXAMPLES

In the following, the present invention is explained in more detail by referring to Examples. In the following, all "part" represent "parts by weight", and "%" is represented by "% by weight".

Preparation Example 1

Preparation of Electron-Donative Dye Precursor Particles to Which a Color-Formation Controlling Layer is Provided Five parts of 3-diethylamino-6-methyl-7-(3-trifluoromethylanilino)fluoran which is an electron-donative dye precursor forming a black color were dissolved in 20 parts of methyl methacrylate which is a compound having an unsaturated carbon bond. This solution was dispersed with 75 parts of a 5% polyvinyl alcohol aqueous solution by a homomixer to obtain a dye precursor dispersion. When the grain size of the dispersion medium in the dispersion was measured by using a MICROTRAC grain analyzer (Series 9200 FRA; trade name, available from Leeds & Northrup Instruments), a volume average particle size was 2.5 μm. In the following, all the volume average particle size was measured by the same means.

Next, this dispersion was transferred to a polymerization apparatus, 0.1 part of 2,2'-azobisisobutyronitrile which is a polymerization initiator was added thereto, and the temperature of the mixture was raised to 70° C. while stirring, and polymerization was carried out for 6 hours. Then, this product was cooled to room temperature to obtain a dispersion of electron-donative dye precursor particles at the surface of which is provided a color-formation controlling layer.

When this dispersion was put through a sieve made of a metal and having an opening of the sieve of 100 μm, about 5% of coagulate based on the total solid component in the dispersion was confirmed.

Preparation Example 2

Preparation of Electron-Donative Dye Precursor Particles to Which a Color-Formation Controlling Layer is Provided Five parts of 3-diethylamino-6-methyl-7-(3-trifluoromethylanilino)fluoran which is an electron-donative dye precursor forming a black color were pulverized by a ball mill with 90 parts of a 2.5% polyvinyl alcohol aqueous solution to obtain a dye precursor dispersion having a volume average particle size of 1 μm. Next, this dispersion was transferred to a polymerization apparatus, 5 parts of methyl methacrylate, which is a compound having the unsaturated carbon atoms, were added thereto, and the temperature of the mixture was raised to 70° C. while stirring. To the mixture was added 0.5part of potassium persulfate which is a polymerization initiator, and, while continuing stirring, polymerization was carried out for 6 hours. Then, this product was cooled to room temperature to obtain a dispersion of electron-donative dye precursor particles at the surface of which are provided a color-formation controlling layer.

When this dispersion was put through a sieve made of a metal and having an opening of the sieve of 100 μm, about 5% of coagulate based on the total solid component in the dispersion was confirmed.

Preparation Example 3

Preparation of Electron-Donative Dye Precursor Particles to Which a Color-Formation Controlling Layer is Provided In the same manner as in Preparation example 2 except for using 5 parts of ethyl methacrylate in place of 5 parts of methyl methacrylate used in Preparation example 2, a dispersion of electron-donative dye precursor particles at the surface of which are provided a color-formation controlling layer was obtained.

When this dispersion was put through a sieve made of a metal and having an opening of the sieve of 100 μm, about 10% of coagulate based on the total solid component in the dispersion was confirmed.

Preparation Example 4

Preparation of Electron-Donative Dye Precursor Particles to Which a Color-Formation Controlling Layer is Provided In the same manner as in Preparation example 2 except for using 5 parts of butyl acrylate in place of 5 parts of methyl methacrylate used in Preparation example 2, a dispersion of electron-donative dye precursor particles at the surface of which are provided a color-formation controlling layer was obtained.

When this dispersion was put through a sieve made of a metal and having an opening of the sieve of 100 μm, about 10% of coagulate based on the total solid component in the dispersion was confirmed.

Preparation Example 5

Preparation of Electron-Donative Dye Precursor Particles to which a Color-Formation Controlling Layer is Provided In the same manner as in Preparation example 2 except for using 3 parts of methyl methacrylate and 2 parts of n-butyl methacrylate in place of 5 parts of methyl methacrylate used in Preparation example 2, a dispersion of electron-donative dye precursor particles at the surface of which are provided a color-formation controlling layer was obtained.

When this dispersion was put through a sieve made of a metal and having an opening of the sieve of 100 lm, about 10% of coagulate based on the total solid component in the dispersion was confirmed.

Preparation Example 6

Preparation of Electron-Donative Dye Precursor Particles to Which a Color-Formation Controlling Layer is Provided In the same manner as in Preparation example 2 except for using 5 parts of styrene in place of 5 parts of methyl methacrylate used in Preparation example 2, a dispersion of electron-donative dye precursor particles at the surface of which are provided a color-formation controlling layer was obtained.

When this dispersion was put through a sieve made of a metal and having an opening of the sieve of 100 μm, about 10% of coagulate based on the total solid component in the dispersion was confirmed.

Preparation Example 7

Preparation of Electron-Donative Dye Precursor Particles to Which a Color-Formation Controlling Layer is Provided In the same manner as in Preparation example 2 except for using 4.5 parts of styrene and 0.5 part of maleic anhydride in place of 5 parts of methyl methacrylate used in Preparation example 2, a dispersion of electron-donative dye precursor particles at the surface of which are provided a color-formation controlling layer was obtained.

When this dispersion was put through a sieve made of a metal and having an opening of the sieve of 100 μm. about 10% of coagulate based on the total solid component in the dispersion was confirmed.

Preparation Example 8

Preparation of Electron-Donative Dye Precursor Particles to Which a Color-Formation Controlling Layer is Provided In the same manner as in Preparation example 2 except for using 0.05 part of 2,2 '-azobisisobutyronitrile in place of 0.05 part of potassium persulfate used in Preparation example 2, a -dispersion of electron-donative dye precursor particles at the surface of which are provided a color-formation controlling layer was obtained.

When this dispersion was put through a sieve made of a metal and having an opening of the sieve of 100 μm, about 15% of coagulate based on the total solid component in the dispersion was confirmed.

Preparation Example 9

Preparation of Electron-Donative Dye Precursor Particles to Which a Color-Formation Controlling Layer is Provided In the same manner as in Preparation example 2 except for using 4.95 parts of methyl methacrylate and 0.05 part of ethylene glycol dimethacrylate in place of 5 parts of methyl methacrylate used in Preparation example 2, a dispersion of electron-donative dye precursor particles at the surface of which are provided a color-formation controlling layer was obtained.

When this dispersion was put through a sieve made of a metal and having an opening of the sieve of 100 μm, about 5% of coagulate based on the total solid component in the dispersion was confirmed.

Preparation Example 10

Preparation of Electron-Donative Dye Precursor Particles to Which a Color-Formation Controlling Layer is Provided In the same manner as in Preparation example 2 except for using 4 parts of methyl methacrylate and 1 part of ethylene glycol dimethacrylate in place of 5 parts of methyl methacrylate used in Preparation example 2, a dispersion of electron-donative dye precursor particles at the surface of which are provided a color-formation controlling layer was obtained.

When this dispersion was put through a sieve made of a metal and having an opening of the sieve of 100 μm, about 5% of coagulate based on the total solid component in the dispersion was confirmed.

Preparation Example 11

Preparation of Electron-Donative Dye Precursor Particles to Which a Color-Formation Controlling Layer is Provided In the same manner as in Preparation example 2 except for using 4 parts of methyl methacrylate and 1 part of trimethylolethane trimethacrylate in place of 5 parts of methyl methacrylate used in Preparation example 2, a dispersion of electron-donative dye precursor particles at the surface of which are provided a color-formation controlling layer was obtained.

When this dispersion was put through a sieve made of a metal and having an opening of the sieve of 100 μm, about 5% of coagulate based on the total solid component in the dispersion was confirmed.

Preparation Example 12

Preparation of Electron-Donative Dye Precursor Particles to Which a Color-Formation Controlling Layer is Provided In the same manner as in Preparation example 2 except for using 2.5 parts of methyl methacrylate and 2.5 parts of ethylene glycol dimethacrylate in place of 5 parts of methyl methacrylate used in Preparation example 2, a dispersion of electron-donative dye precursor particles at the surface of which are provided a color-formation controlling layer was obtained.

When this dispersion was put through a sieve made of a metal and having an opening of the sieve of 100 μm, about 5% of coagulate based on the total solid component in the dispersion was confirmed.

Preparation Example 13

Preparation of Electron-Donative Dye Precursor Particles to Which a Color-Formation Controlling Layer is Provided Five parts of 3-diethylamino-6-methyl-7-(3-trifluoromethylanilino)fluoran which is an electron-donative dye precursor forming a black color were pulverized by a ball mill with 92 parts of a 2.5% polyvinyl alcohol aqueous solution to obtain a dye precursor dispersion having a volume average particle size of 1 μm. Also, 1 part of methyl methacrylate which is a compound having an unsaturated carbon bond is added to 2 parts of a 2.5% polyvinyl alcohol aqueous solution and the mixture was dispersed by a homomixer to obtain a monomer dispersed emulsion having a volume average particle size of 15 μm. Next, the above two kinds of dispersions were transferred to a polymerization apparatus, and the temperature of the mixture was raised to 70° C. while stirring. To the mixture was added 0.01 part of potassium persulfate which is a polymerization initiator, and, while continuing stirring, polymerization was carried out for 6 hours. Then, this product was cooled to room temperature to obtain a dispersion of electron-donative dye precursor particles at the surface of which are provided a color-formation controlling layer.

When this dispersion was put through a sieve made of a metal and having an opening of the sieve of 100 μm, about 1% of coagulate based on the total solid component in the dispersion was confirmed.

Preparation Example 14

Preparation of Electron-Donative Dye Precursor Particles to Which a Color-Formation Controlling Layer is Provided Five parts of 3-diethylamino-6-methyl-7-(3-trifluoromethylanilino)fluoran which is an electron-donative dye precursor forming a black color were pulverized by a ball mill with 80 parts of a 2.5% polyvinyl alcohol aqueous solution to obtain a dye precursor dispersion having a volume average particle size of 1 μm. Also, 5 parts of methyl methacrylate which is a compound having an unsaturated carbon bond is added to 10 parts of a 2.5% polyvinyl alcohol aqueous solution and the mixture was dispersed by a homomixer to obtain a monomer dispersed emulsion having a volume average particle size of 15 μm. Next, the above two kinds of dispersions were transferred to a polymerization apparatus, and the temperature of the mixture was raised to 70° C. while stirring. To the mixture was added 0.05 part of potassium persulfate which is a polymerization initiator, and, while continuing stirring, polymerization was carried out for 6 hours. Then, this product was cooled to room temperature to obtain a dispersion of electron-donative dye precursor particles at the surface of which are provided a color-formation controlling layer.

When this dispersion was put through a sieve made of a metal and having an opening of the sieve of 100 μm, about 1% of coagulate based on the total solid component in the dispersion was confirmed.

Preparation Example 15

Preparation of Electron-Donative Dye Precursor Particles to Which a Color-Formation Controlling Layer is Provided Five parts of 3-diethylamino-6-methyl-7-(3-trifluoromethylanilino)fluoran which is an electron-donative dye precursor forming a black color were pulverized by a ball mill with 35 parts of a 2.5% polyvinyl alcohol aqueous solution to obtain a dye precursor dispersion having a volume average particle size of 1 μm. Also, 20 parts of methyl methacrylate which is a compound having an unsaturated carbon bond is added to 40 parts of a 2.5% polyvinyl alcohol aqueous solution and the mixture was dispersed by a homomixer to obtain a monomer dispersed emulsion having a volume average particle size of 15 μm. Next, the above two kinds of dispersions were transferred to a polymerization apparatus, and the temperature of the mixture was raised to 70° C. while stirring. To the mixture was added 0.1 part of potassium persulfate which is a polymerization initiator, and, while continuing stirring, polymerization was carried out for 6 hours. Then, this product was cooled to room temperature to obtain a dispersion of electron-donative dye precursor particles at the surface of which are provided a color-formation controlling layer.

When this dispersion was put through a sieve made of a metal and having an opening of the sieve of 100 μm, about 1% of coagulate based on the total solid component in the dispersion was confirmed.

Preparation Example 16

Preparation of Electron-Donative Dye Precursor Particles to Which a Color-Formation Controlling Layer is Provided Five parts of 3-diethylamino-6-methyl-7-(3-trifluoromethylanilino)fluoran which is an electron-donative dye precursor forming a black color were pulverized by a ball mill with 90 parts of a 2.5% polyvinyl alcohol aqueous solution to obtain a dye precursor dispersion having a volume average particle size of 1 μm. Next, this dispersion was transferred to a polymerization apparatus, and the temperature of the dispersion was raised to 70° C. while stirring. To the mixture were added 1.25 parts of methyl methacrylate which is a compound having an unsaturated carbon bond and 0.0125 part of potassium persulfate which is a polymerization initiator four times in total every one hour, and polymerization was carried out for 6 hours under stirring. Then, this product was cooled to room temperature to obtain a dispersion of electron-donative dye precursor particles at the surface of which are provided a color-formation controlling layer.

When this dispersion was put through a sieve made of a metal and having an opening of the sieve of 100 μm. about 5% of coagulate based on the total solid component in the dispersion was confirmed.

Preparation Example 17

Preparation of Electron-Donative Dye Precursor Particles to Which a Color-Formation Controlling Layer is Provided Five parts of 3-diethylamino-6-methyl-7-(3-trifluoromethylanilino)fluoran which is an electron-donative dye precursor forming a black color were pulverized by a ball mill with 80 parts of a 2.5% polyvinyl alcohol aqueous solution to obtain a dye precursor dispersion having a volume average particle size of 1 μm. Also, 4 parts of methyl methacrylate and 1 part of ethylene glycol dimethacrylate which are compounds having an unsaturated carbon bond are added to 10 parts of a 2.5% polyvinyl alcohol aqueous solution and the mixture was dispersed by a homomixer to obtain a monomer dispersed emulsion having a volume average particle size of 15 μm. Next, the above-mentioned dye precursor dispersion was transferred to a polymerization apparatus, and the temperature of the dispersion was raised to 70° C. while stirring. To the dye precursor dispersion were added 3.75 parts of the above-mentioned monomer dispersed emulsion and 0.0125 part of potassium persulfate which is a polymerization initiator four times in total every one hour, and polymerization was carried out for 6 hours under stirring. Then, this product was cooled to room temperature to obtain a dispersion of electron-donative dye precursor particles at the surface of which are provided a color-formation controlling layer.

When this dispersion was put through a sieve made of a metal and having an opening of the sieve of 100 μm, about 1% of coagulate based on the total solid component in the dispersion was confirmed.

Preparation Example 18

Preparation of Electron-Donative Dye Precursor Particles to Which a Color-Formation Controlling Layer is Provided In the same manner as in Preparation example 17 except for using 5 parts of 3-dibutylamino-6-methyl-7-anilinofluoran in place of 5 parts of 3-diethylamino-6-methyl-7-(3-trifluoromethylanilino)fluoran anilino)fluoran which is an electron-donative dye precursor used in Preparation example 17, a dispersion of electron-donative dye precursor particles at the surface of which are provided a color-formation controlling layer was obtained.

When this dispersion was put through a sieve made of a metal and having an opening of the sieve of 100 μm, 1% or less of coagulate based on the total solid component in the dispersion was confirmed.

Preparation Example 19

Preparation of Electron-Donative Dye Precursor Particles to Which a Color-Formation Controlling Layer is Provided In the same manner as in Preparation example 17 except for using 5 parts of 3-(N-methyl-N-cyclohexyl)amino-6-methyl-7-anilinofluoran in place of 5 parts of 3-diethylamino-6-methyl-7-(3-trifluoromethylanilino) fluoran which is an electron-donative dye precursor used in Preparation example 17, a dispersion of electron-donative dye precursor particles at the surface of which are provided a color-formation controlling layer was obtained.

When this dispersion was put through a sieve made of a metal and having an opening of the sieve of 100 μm, 1% or less of coagulate based on the total solid component in the dispersion was confirmed.

Preparation Example 20

Preparation of Electron-Donative Dye Precursor Particles to Which a Color-Formation Controlling Layer is Provided Five parts of 4,4',4',4"-triisocyanato-2,5-dimethoxytriphenyl amine which is an isocyanate compound were pulverized by a ball mill with 90 parts of a 2.5% polyvinyl alcohol aqueous solution to obtain a isocyanate compound dispersion having a volume average particle size of 1 μm. Next, this dispersion was transferred to a polymerization apparatus, 4 parts of methyl methacrylate and 1 part of ethylene glycol dimethacrylate which are compounds having the unsaturated carbon atoms were added thereto, and the temperature of the mixture was raised to 40° C. while stirring. To the mixture were added 0.05 part of potassium persulfate and 0.05 part of acidic sodium sulfite which are polymerization initiators, and, while continuing stirring, polymerization was carried out for 8 hours. Then, this product was cooled to room temperature to obtain a dispersion of electron-donative dye precursor particles at the surface of which are provided a color-formation controlling layer.

When this dispersion was put through a sieve made of a metal and having an opening of the sieve of 100 μm, about 5% of coagulate based on the total solid component in the dispersion was confirmed.

Preparation Example 21

Preparation of Composite Particles Comprising a Polymer Substance Selected from a Polyurea and a Polyurethane, and an Electron-Donative Dye Precursor Six parts of 3-diethylamino-6-methyl-7-(3-trifluoromethylanilino)fluoran which is an electron-donative dye precursor forming a black color were dissolved in 30 parts of methylene chloride. Then, to the solution was added 12 parts of an adduct of trimethylolpropane and xylylene diisocyanate with a molar ratio of 1:3 (Takenate d-110N, trade name, diluent: ethyl acetate, concentration of 75%, available from Takeda Chemical Industries, Ltd.) and the mixture was uniformly mixed. The mixture was added to 250 parts of a 5% polyvinyl alcohol aqueous solution, and the mixture was dispersed at 25° C. by using a homomixer. Then, the temperature of the mixture was raised to 45° C. and stirring was continued for 5 hours to evaporate and remove methylene chloride and ethyl acetate. Thereafter, the temperature of the mixture was raised to 80° C. and curing reaction was carried out for 3 hours to obtain a dispersion of composite particles comprising a polymer substance selected from a polyurea and a polyurethane, and the electron-donative dye precursor, and having a volume average particle size of 1.8 μm. When this dispersion was put through a sieve made of a metal and having an opening of the sieve of 100 μm, about 10% of coagulate based on the total solid component in the dispersion was confirmed.

Preparation Example 22

Preparation of an Electron-Donative Dye Precursor Encapsulated in Microcapsule

Five parts of 3-diethylamino-6-methyl-7-(3-trifluoromethylanilino)fluoran which is an electron-donative dye precursor forming a black color were dissolved in 20 parts of 1-(3,4-dimethylphenyl)-1-phenylethane. Then, to the solution were added 6.5 parts of a mixture of diphenylmethane-4,4'-diisocyanate and 1,2-bis(p-(p-isocyanatobenzyl)phenylaminocarbonyloxy)ethane with a ratio of 1:1 and 6.5 parts of ethyl acetate as an auxiliary solvent, and the mixture was uniformly dissolved. The solution was mixed with 80 parts of a 5% polyvinyl alcohol aqueous solution, and the mixture was dispersed at 25° C. by using a homomixer to obtain an emulsion having a volume average particle size of 2 μm. An aqueous solution in which 3 parts of diethylenetriamine was dissolved in 14 parts of distilled water was added to the resulting emulsion, and while stirring, the mixture was maintained at 80° C. by heating for 3 hours to obtain a dispersion of the electron-donative dye precursor encapsulated in microcapsule. When this dispersion was put through a sieve made of a metal and having an opening of the sieve of 100 μm, about 10% of coagulate based on the total solid component in the dispersion was confirmed.

Example 1

Preparation of Heat-Sensitive Recording Material

Four parts of 3,3'-diallyl-4,4'-dihydroxydiphenyl sulfone which is an electron-accepting compound were pulverized by a ball mill with 12 parts of a 2% polyvinyl alcohol aqueous solution to obtain 16 parts of a dispersion of the electron-accepting compound having a volume average particle size of 1 μm. Also, 4 parts of 2-benzyloxynaphthalene were pulverized by a ball mill with 12 parts of a 2% polyvinyl alcohol aqueous solution to obtain 16 parts of a dispersion of 2-benzyloxynaphthalene having a volume average particle size of 1 μm. Moreover, 5 parts of calcium carbonate (Unibur-70, trade name, available from Shiraishi Kogyo Kaisha, Ltd.) were pulverized by a homogenizer with 10 parts of a 2% sodium hexametaphosphate aqueous solution to obtain 15 parts of a dispersion of calcium carbonate having a volume average particle size of 1 μm. The above three-kinds of dispersions and 70 parts of the dispersion of the electron-donative dye precursor particles to which a color-formation controlling layer had been provided obtained in Preparation example 1 were mixed to prepare a coating solution for a heat-sensitive recording material.

This coating solution was coated on a polyethylene terephthalate (PET) sheet having a thickness of 100 μm so as to have a solid component coated amount of 3 g/m$^2$, dried in an oven at 60° C. to prepare a heat-sensitive recording material.

Examples 2 to 19

Preparation of Heat-Sensitive Recording Materials

In the same manner as in Example 1 except for using the dispersions of the electron-donative dye precursor particles to which a color-formation controlling layer had been provided obtained in Preparation examples 2 to 19 in place of the dispersion of the electron-donative dye precursor particles to which a color-formation controlling layer had been provided obtained in Preparation example 1 used in Example 1, heat-sensitive recording materials were prepared, respectively.

Example 20

Preparation of Heat-Sensitive Recording Material

Six parts of 1,3-diimino-4,5,6,7-tetrachloroisoindoline which is an imino compound were pulverized by a ball mill with 14 parts of a 2% polyvinyl alcohol aqueous solution to obtain 20 parts of a dispersion of the imino compound having a volume average particle size of 1 μm. Also, 6 parts of 2-benzyloxynaphthalene were pulverized by a ball mill with 14 parts of a 2% polyvinyl alcohol aqueous solution to obtain 20 parts of a dispersion of 2-benzyloxynaphthalene having a volume average particle size of 1 μm. Moreover, 5 parts of calcium carbonate (Unibur-70, trade name, available from Shiraishi Kogyo Kaisha, Ltd.) were pulverized by a homogenizer with 10 parts of a 2% sodium hexametaphosphate aqueous solution to obtain 15 parts of a dispersion of calcium carbonate having a volume average particle size of 1 μm. The above three-kinds of dispersions and 60 parts of the dispersion of the isocyanate compound particles to which a color-formation controlling layer had been provided obtained in Preparation example 20 were mixed to prepare a coating solution for a heat-sensitive recording material.

This coating solution was coated on a polyethylene terephthalate (PET) sheet having a thickness of 100 μm so as to have a solid component coated amount of 4 g/m$^2$, dried in an oven at 60° C. to prepare a heat-sensitive recording material.

Example 21

Preparation of Multi-Colored Heat-Sensitive Recording Material

Three parts of 3-diethylamino-7-chlorofluoran which is a dye precursor of forming a red color were pulverized by a ball mill with 7 parts of a 2% polyvinyl alcohol aqueous solution to obtain 10 parts of a dye precursor dispersion having a volume average particle size of 1 μm. Then, 8 parts of 3,3'-diallyl-4,4'-dihydroxyphenyl sulfone which is an electron-accepting compound were pulverized by a ball mill with 20 parts of a 2% polyvinyl alcohol aqueous solution to obtain 28 parts of an electron-accepting compound dispersion having a volume average particle size of 1 μm. Also, 6 parts of 2-benzyloxynaphthalene were pulverized by a ball mill with 14 parts of a 2% polyvinyl alcohol aqueous solution to obtain 20 parts of a dispersion of 2-benzyloxynaphthalene having a volume average particle size of 1 μm. Moreover, 8 parts of calcium carbonate (Unibur-70, trade name, available from Shiraishi Kogyo Kaisha, Ltd.) were pulverized by a homogenizer with 16 parts of a 2% sodium hexametaphosphate aqueous solution to obtain 24 parts of a dispersion of calcium carbonate having a volume average particle size of 1 μm. The above four-kinds of dispersions and 60 parts of the dispersion of the electron-donative dye precursor particles to which a color-formation controlling layer had been provided obtained in Preparation example 10 were mixed to prepare a coating solution for a multi-colored heat-sensitive recording material.

This coating solution was coated on a polyethylene terephthalate (PET) sheet having a thickness of 100 μm so as to have a solid component coated amount of 4 g/m$^2$, dried in an oven at 60° C. to prepare a multi-colored heat-sensitive recording material.

Example 22

Preparation of Multi-Colored Heat-Sensitive Recording Material

In the same manner as in Example 21 except for using the dispersion of the electron-donative dye precursor particles to which a color-formation controlling layer had been provided obtained in Preparation example 17 in place of the dispersion of the electron-donative dye precursor particles to which a color-formation controlling layer had been provided obtained in Preparation example 10 used in Example 21, a multi-colored heat-sensitive recording material was prepared.

Comparative Example 1

Preparation of Heat-Sensitive Recording Material

In the same manner as in Example 1 except for using 12 parts of the dispersion of the electron-donative dye precursor having a volume average particle size of 1 μm prepared by pulverizing 3.5 parts of 3-diethylamino-6-methyl-7-(3-trifluoromethylanilino)fluoran which is an electron-donative dye precursor forming a black color by a ball mill with 8.5 parts of a 2% polyvinyl alcohol aqueous solution in place of 70 parts of the dispersion of the electron-donative dye precursor particles to which a color-formation controlling layer had been provided obtained in Preparation example 1 used in Example 1, a heat-sensitive recording material was prepared.

Comparative Example 2

Preparation of Heat-Sensitive Recording Material

In the same manner as in Example 1 except for using 154.6 parts of the dispersion of composite particles comprising the polymer substance selected from the polyurea and the polyurethane, and the electron-donative dye precursor prepared in Preparation example 21 in place of 70 parts of the dispersion of the electron-donative dye precursor particles to which a color-formation controlling layer had been provided obtained in Preparation example 1 used in Example 1, a heat-sensitive recording material was prepared.

Comparative Example 3

Preparation of Heat-Sensitive Recording Material

In the same manner as in Example 1 except for using 94.5 parts of the dispersion of the electron-donative dye precursor encapsulated in microcapsule prepared in Preparation example 22 in place of 70 parts of the dispersion of the electron-donative dye precursor particles to which a color-formation controlling layer had been provided obtained in Preparation example 1 used in Example 1, a heat-sensitive recording material was prepared.

Comparative Example 4

Preparation of Heat-Sensitive Recording Material

In the same manner as in Example 20 except for using 10 parts of the dispersion of the isocyanate compound having a volume average particle size of 1 μm prepared by pulverizing 3 parts of 4,4',4"-triisocyanato-2,5-dimethoxytriphenylamine which is an isocyanate compound by a ball mill with 7 parts of a 2% polyvinyl alcohol aqueous solution in place of 60 parts of the dispersion of the electron-donative dye precursor particles to which a color-formation controlling layer had been provided obtained in Preparation example 20 used in Example 20, a heat-sensitive recording material was prepared.

Comparative Example 5

Preparation of Multi-Colored Heat-Sensitive Recording Material

In the same manner as in Example 21 except for using 12 parts of the dispersion of the electron-donative dye precursor having a volume average particle size of 1 μm prepared by pulverizing 3 parts of 3-diethylamino-6-methyl-7-(3-trifluoromethylanilino)fluoran which is an electron-donative dye precursor forming a black color by a ball mill with 9 parts of a 2% polyvinyl alcohol aqueous solution in place of 60 parts of the dispersion of the electron-donative dye precursor particles to which a color-formation controlling layer had been provided obtained in Preparation example 1 used in Example 21, a multi-colored heat-sensitive recording material was prepared.

Comparative Example 6

Preparation of Multi-Colored Heat-Sensitive Recording Material

In the same manner as in Example 21 except for using 132.5 parts of the dispersion of composite particles comprising the polymer substance selected from the polyurea and the polyurethane, and the electron-donative dye precursor prepared in Preparation example 21 in place of 60 parts of the dispersion of the electron-donative dye precursor particles to which a color-formation controlling layer had been provided obtained in Preparation example 1 used in Example 21, a multi-colored heat-sensitive recording material was prepared.

Comparative Example 7

Preparation of Multi-Colored Heat-Sensitive Recording Material

In the same manner as in Example 21 except for using 81 parts of the dispersion of the electron-donative dye precursor encapsulated in microcapsule prepared in Preparation example 22 in place of 60 parts of the dispersion of the electron-donative dye precursor particles to which a color-formation controlling layer had been provided obtained in Preparation example 1 used in Example 21, a multi-colored heat-sensitive recording material was prepared.

Evaluation Test 1 Color-Formation Sensitivity Test

A heated metal block was pressed against the respective heat-sensitive recording materials of Examples 1 to 20 and those of Comparative examples 1 to 4 for 3 seconds, and a temperature at which color-forms was observed. The temperature at which color-forms is made a temperature at which color-forms a density of 1.0 or more, and the density was measured by using a densitometer (Macbeth RD918, trade name, available from GRETAG MACBETH CO.) at the position of a filter hole with a black color. The results are shown in Table 1 at the column of "Color-forming temperature".

Evaluation Test 2 Background Fogging Measurement Test

With regard to the respective heat-sensitive recording materials of Examples 1 to 20 and those of Comparative examples 1 to 4, the state of background fogging was measured by the density at the background non-printed portion. The density was measured by using a densitometer (Macbeth RD918, trade name, available from GRETAG MACBETH CO.) at the position of a filter hole with a black color. The results are shown in Table 1 at the column of "Background fogging".

Evaluation Test 3 Color-Forming Test at Non-Printed Portion by Organic Solvent

At non-printed portions of the respective heat-sensitive recording materials of Examples 1 to 20 and those of Comparative examples 1 to 4, 5 mg of ethanol was dropped by a syringe, and the density of the formed color was measured by using a densitometer (Macbeth RD918, trade name, available from GRETAG MACBETH CO.) at the position of a filter hole with a black color. The results are shown in Table 1 at the column of "Solvent resistance".

Evaluation Test 4 Sensitivity Test of Starting Color-Formation

A heated metal block was pressed against the respective heat-sensitive recording materials of Examples 1 to 20 and that of Comparative example 2 for 3 seconds, and the difference between the maximum temperature at which color-forms a density of 0.2 or less and the minimum temperature at which color-forms a density of 1.0 or more was observed. The temperature at which color-forms is made a temperature at which color-forms a density of 1.0 or more, and the density was measured by using a densitometer (Macbeth RD918, trade name, available from GRETAG MACBETH CO.) at the position of a filter hole with a black color. The results are shown in Table 1 at the column of "Start of color-formation". This sensitivity test of starting color-formation is effective only for Examples and Comparative example in which color-formation sensitivity can be delayed. Thus, as for Comparative examples 1, 3 and 4 in which no delay in sensitivity was observed, the test was not carried out.

TABLE 1

| | Color-forming temperature | Background fogging | Solvent resistance | Start of color-formation |
|---|---|---|---|---|
| Example 1 | 90° C. | Δ | ○ | Δ |
| Example 2 | 95° C. | ○ | ○ | ○ |
| Example 3 | 94° C. | ○ | ○ | ○ |
| Example 4 | 90° C. | ○ | ○ | ○ |
| Example 5 | 94° C. | ○ | ○ | ○ |
| Example 6 | 90° C. | ○ | ○ | ○ |
| Example 7 | 90° C. | ○ | ○ | ○ |
| Example 8 | 95° C. | ○ | ○ | ○ |
| Example 9 | 94° C. | ○ | ◎ | ○ |
| Example 10 | 122° C. | ◎ | ◎ | ○ |
| Example 11 | 128° C. | ◎ | ◎ | ○ |
| Example 12 | 155° C. | ◎ | ◎ | ○ |
| Example 13 | 95° C. | ○ | ○ | ○ |
| Example 14 | 105° C. | ○ | ○ | ○ |
| Example 15 | 110° C. | ○ | ○ | ○ |
| Example 16 | 97° C. | ○ | ○ | ◎ |
| Example 17 | 125° C. | ◎ | ◎ | ◎ |
| Example 18 | 125° C. | ◎ | ◎ | ◎ |
| Example 19 | 127° C. | ◎ | ◎ | ◎ |
| Example 20 | 106° C. | ○ | ○ | ○ |
| Comparative example 1 | 80° C. | X | X | — |
| Comparative example 2 | 123° C. | ○ | Δ | X |
| Comparative example 3 | 83° C. | X | X | — |
| Comparative example 4 | 83° C. | X | X | — |

The symbol ◎ at the column of background fogging in Table 1 5 shows the state that the density is 0.05 or less and there is completely no background fogging; the symbol ○ of the same shows the state that the density is 0.06 or 0.07 and there is substantially no background fogging; the symbol Δ of the same shows the state that the density is 0.08 or more to 0.10 or less 10 and there is background fogging but the fogging is not noticeable; and the symbol X of the same shows the state that the density is 0.11 or more and background fogging is noticeable.

Also, the symbol ◎ at the column of solvent resistance in Table 1 shows the state that the density is less than 0.1 and color is never formed; the symbol ○ of the same shows the state that the density is 0.1 or more to less than 0.3 and color is substantially not formed; the symbol Δ of the same shows the state that the density is 0.3 or more to less than 0.5 and slightly color formed; and the symbol X of the same shows the state that the density is 0.5 or more and color is formed.

Moreover, the symbol ◎ at the column of start of color-formation in Table 1 shows the state that start of color-formation with the temperature difference of less than 5° C. is extremely steep; the symbol ○ of the same shows the state that start of color-formation with the temperature difference of 5° C. or more and less than 10° C. is steep; the symbol Δ of the same shows the state that start of color-formation with the temperature difference of 10° C. or more and less than 15° C. is slightly gentle; and the symbol X of the same shows the state that start of color-formation with the temperature difference of 15° C. or more is gentle.

As clearly seen from Table 1, in the heat-sensitive recording materials of Examples 1 to 20, it is possible to delay a color-formation temperature, and it can be understood that background fogging and resistance to a solvent of the heat-sensitive recording materials can be improved due to the presence of the color-formation controlling layer. To the contrary, in the heat-sensitive recording material of Comparative example 2, whereas the color-formation temperature is delayed, start of color-formation becomes gentle.

Evaluation Test 5 Printing Test of Multi-Colored Heat-Sensitive Recording Material By using a heat-sensitive facsimile printing test machine (TH-PMD, trade name, available from Ohkura Denki Co., Ltd.) attached with a printing head (LH4409, trade name, available from TDK Corporation), printing was carried out with regard to the multi-colored heat-sensitive recording materials of Examples 21 and 22, and those of Comparative examples 5 to 7 under the conditions of an applied voltage of 20 volts, an applied pulse of 1.0 millisecond (low energy printing) and an appliedpulse of 2.0 millisecond (high energy printing). Color tones of the formed colors at the printed portion are observed with eyes. The results are shown in Table 2.

TABLE 2

| | Formed color tone by low energy printing | Formed color tone by high energy printing | Color separation |
|---|---|---|---|
| Example 21 | Bright red | Black | ○ |
| Example 22 | Bright red | Black | ◎ |
| Comparative example 5 | Black | Black | X |
| Comparative example 6 | Red | Reddish black | Δ |
| Comparative example 7 | Blackish red | Black | X |

In Table 2, the symbol ◎ shows the state that difference in color-formed color tones by the low energy printing and the high energy printing is extremely clear; the symbol ○ shows the state that difference in color-formed color tones is clear; the symbol Δ shows the state that difference in color-formed color tones is unclear; the symbol X shows the state that difference in color-formed color tones cannot be confirmed; and ◎ and ○ are levels practically no problem.

As clearly seen from Table 2, in the multi-colored heat-sensitive recording materials of Examples 21 and 22, color-formations of bright red and black can be obtained whereby the multi-colored heat-sensitive recording materials which are clear in color separation can be obtained. To the contrary, in the multi-colored heat-sensitive recording material of Comparative example 6, the color-formed portion at which black color is formed is reddish and color separation is unclear. Also, the multi-colored heat-sensitive recording materials of Comparative examples 5 and 7, multi-colored printing of red and black was impossible.

As shown in Tables 1 and 2, in a heat-sensitive recording material in which a heat-sensitive recording layer mainly containing a heat-sensitive recording component which forms a color by heating provided on a support, by constituting said heat-sensitive recording component with two kinds or more of compounds and by presenting at least one of a compound constituting said heat-sensitive recording component in the state of particles on the surface of which is provided a color-formation controlling layer obtained by polymerizing a compound having an unsaturated carbon bond in a heat-sensitive recording layer, a heat-sensitive recording material in which color-forming characteristics such as a color-formation temperature, etc. are well controlled can be obtained.

Also, in the heat-sensitive recording material in which a color-formation controlling layer is formed on the surface of particles of a compound to be added to the heat-sensitive recording component by adding a compound having an unsaturated carbon bond and subjecting the compound having an unsaturated carbon bond to addition polymerization, the color-formation controlling layer can be formed with good productivity.

Moreover, according to the present invention, a heat-sensitive recording material which color-forms two kinds or more of color tones due to the difference in heating temperatures can be obtained.

What is claimed is:

1. A heat-sensitive recording material having a support and provided thereon a heat-sensitive recording layer mainly comprising a heat-sensitive recording component which forms a color by heating, the improvement wherein said heat-sensitive recording component comprises two or more kinds of compounds, and the heat-sensitive recording layer contains at least one of the compounds constituting said heat-sensitive recording component in the state of a solid particle on the surface of which is formed a color-formation controlling layer comprising a polymer of a compound having an unsaturated carbon bond.

2. The heat-sensitive recording material according to claim 1, wherein the compound having an unsaturated carbon bond is used in an amount of 0.5% by weight or more to 1000% by weight or less based on the particles of the compound constituting the heat-sensitive recording component to which the color-formation controlling layer is formed.

3. The heat-sensitive recording material according to claim 1, wherein a compound having two or more unsaturated carbon bonds is contained in the compound having an unsaturated carbon bond in an amount of 1% by weight or more and 70% by weight or less based on the total weight of the compound having an unsaturated carbon bond.

4. The heat-sensitive recording material according to claim 3, wherein the compound having 2 or more unsaturated carbon bonds is a compound represented by the following formula (I), (II) or (III), or a mixture of at least two of these compounds or a polymerized product of at least one of these compounds:

(I)

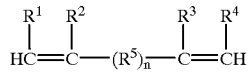

wherein n represents 0 or 1; $R^1$, $R^2$, $R^3$ and $R^4$ each represent a hydrogen atom, a halogen atom, an alkyl group, an alkoxycarbonyl group or an alkoxycarbonylmethyl group; and $R^5$ is a divalent group having a number of atoms of 50 or less other than the hydrogen atoms contained in $R^5$;

(II)

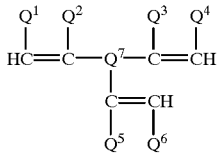

wherein $Q^1$, $Q^2$, $Q^3$, $Q^4$, $Q^5$ and $Q^6$ each represent a hydrogen atom, a halogen atom, an alkyl group, an alkoxycarbonyl group or an alkoxycarbonylmethyl group, and $Q^7$ represents a trivalent group having a number of atoms of 50 or less other than the hydrogen atoms contained in $Q^7$; and (III)

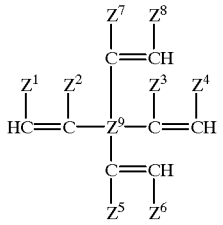

wherein $Z^1$, $Z^2$, $Z^3$, $Z^4$, $Z^5$, $Z^6$, $Z^7$ and $Z^8$ each represent a hydrogen atom, a halogen atom, an alkyl group, an alkoxycarbonyl group or an alkoxycarbonylmethyl group, and $Z^9$ represents a tetravalent group having a number of atoms of 50 or less other than the hydrogen atoms contained in $Z^9$.

5. The heat-sensitive recording material according to claim 1, wherein the compound constituting the heat-sensitive recording component is a usually colorless or pale-colored electron-donative dye precursor and an electron-accepting compound which color-forms said dye precursor.

6. The heat-sensitive recording material according to claim 1, wherein an isocyanate compound is contained as the compound constituting the heat-sensitive recording component.

7. The heat-sensitive recording material according to claim 1, wherein the heat-sensitive recording layer contains two kinds or more of heat-sensitive recording components different in formed color tone and a color-formation controlling layer is formed on the surface of at least one of the compounds constituting said heat-sensitive recording component to control a temperature of color-formation whereby two or more kinds of color tones are developed by different heating temperatures.

8. The heat-sensitive recording material according to claim 1, wherein the color-formation controlling layer is formed by adding the compound having an unsaturated carbon bond to a dispersion of a compound constituting said heat-sensitive recording component and subjecting said compound having an unsaturated carbon bond to addition polymerization.

9. The heat-sensitive recording material according to claim 8, wherein a volume average particle size of the particle of the compound constituting the heat-sensitive recording component to which the color-formation controlling layer is formed is 0.1 $\mu$m or more to 20 $\mu$m or less.

10. The heat-sensitive recording material according to claim 8, wherein a dispersing medium for dispersing the compound constituting the heat-sensitive recording component contains 50% by weight or more of water.

11. The heat-sensitive recording material according to claim 10, wherein a water-soluble polymerization initiator is used for subjecting the compound having an unsaturated carbon bond to addition polymerization.

12. The heat-sensitive recording material according to claim 11, wherein the water-soluble polymerization initiator is used in an amount of 0.001% by weight or more to 10% by weight or less based on the amount of the compound having an unsaturated carbon bond.

13. The heat-sensitive recording material according to claim 10, wherein the compound having an unsaturated carbon bond is a methacrylate or a mixture of a methacrylate and other compound having an unsaturated carbon bond.

14. The heat-sensitive recording material according to claim 8, wherein the compound having an unsaturated carbon bond is added to a dispersion of particles of the compound constituting the heat-sensitive recording component to which the color-formation controlling layer is formed in the state of a dispersion by suspending and dispersing in a dispersing medium.

15. The heat-sensitive recording material according to claim 14, wherein a suspended drop of the compound having an unsaturated carbon bond in a suspended dispersion has a volume average particle diameter of 1 $\mu$m or more to 100 $\mu$m or less.

16. The heat-sensitive recording material according to claim 8, wherein the compound having an unsaturated carbon bond is added two or more times to a dispersion of particles of the compound constituting the heat-sensitive recording component to which the color-formation controlling layer is formed by dividing into two or more portions so that the color-formation controlling layer is formed on the surface of said particles by two or more times.

17. The heat-sensitive recording material according to claim 8, wherein the compound having an unsaturated carbon bond is used in an amount of 0.5% by weight or more to 1000% by weight or less based on the particles of the compound constituting the heat-sensitive recording component to which the color-formation controlling layer is formed.

18. The heat-sensitive recording material according to claim 8, wherein a compound having two or more unsaturated carbon bonds is contained in the compound having an unsaturated carbon bond in an amount of 1% by weight or more and 70% by weight or less based on the total weight of the compound having an unsaturated carbon bond.

19. The heat-sensitive recording material according to claim 18, wherein the compound having 2 or more unsaturated carbon bonds is a compound represented by the following formula (I), (II) or (III), or a mixture of at least two of these compounds or a polymerized product of at least one of these compounds:

(I)

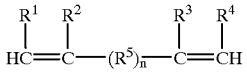

wherein n represents 0 or 1; $R^1$, $R^2$, $R^3$ and $R^4$each represent a hydrogen atom, a halogen atom, an alkyl group, an alkoxycarbonyl group or an alkoxycarbonylmethyl group; and $R^5$ is a divalent group having a number of atoms of 50 or less other than the hydrogen atoms contained in $R^5$;

(II)

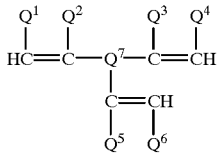

wherein $Q^1$, $Q^2$, $Q^3$, $Q^4$, $Q^5$ and $Q^6$ each represent a hydrogen atom, a halogen atom, an alkyl group, an alkoxycarbonyl group or an alkoxycarbonylmethyl group, and $Q^7$ represents a trivalent group having a number of atoms of 50 or less other than the hydrogen atoms contained in $Q^7$; and (III)

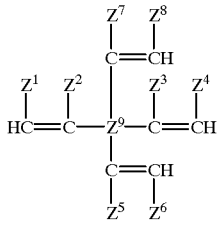

wherein $Z^1$, $Z^2$, $Z^3$, $Z^4$, $Z^5$, $Z^6$, $Z^7$ and $Z^8$ each represent a hydrogen atom, a halogen atom, an alkyl group, an alkoxycarbonyl group or an alkoxycarbonylmethyl group, and $Z^9$ represents a tetravalent group having a number of atoms of 50 or less other than the hydrogen atoms contained in $Z^9$.

20. The heat-sensitive recording material according to claim 8, wherein the compound constituting the heat-sensitive recording component is a usually colorless or pale-colored electron-donative dye precursor and an electron-accepting compound which color-forms said dye precursor.

21. The heat-sensitive recording material according to claim 8, wherein an isocyanate compound is contained as the compound constituting the heat-sensitive recording component.

22. The heat-sensitive recording material according to claim 8, wherein the heat-sensitive recording layer contains two kinds or more of heat-sensitive recording components different in formed color tone and a color-formation controlling layer is formed on the surface of at least one of the compounds constituting said heat-sensitive recording component to control a temperature of color-formation whereby two or more kinds of color tones are developed by different heating temperatures.

23. A process for making a heat-sensitive recording material according to claim 1, comprising the steps of dispersing particles of a compound constituting the heat-sensitive recording component in a dispersing medium to prepare a dispersion, adding a compound having an unsaturated carbon bond to the dispersion, subjecting to addition polymerization of the compound having an unsaturated carbon bond to form the color-formation controlling layer on the particles, coating a coating solution containing two or more heat-sensitive recording components at least one of which being the above particles on the support and drying to form the heat-sensitive recording layer.

24. The process according to claim 23, wherein the compound having an unsaturated carbon bond is used in an amount of 0.5 to 1000% by weight based on the particles of the compound constituting the heat-sensitive recording component to which the color-formation controlling layer is formed.

25. The process according to claim 23, wherein a compound having two or more unsaturated carbon bond is contained in the compound having an unsaturated carbon bond in an amount of 1 to 70% by weight based on the total weight of the compound having an unsaturated carbon bond.

26. The process according to claim 25, wherein the compound having two or more unsaturated carbon bonds is a compound represented by the following formula (I), (II) or (III), or a mixture of at least two of these compounds or a polymerized product of at least one of these compounds:

(I)

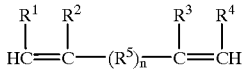

wherein n represents 0 or 1; $R^1$, $R^2$, $R^3$ and $R^4$ each represent a hydrogen atom, a halogen atom, an alkyl group, an alkoxycarbonyl group or an alkoxycarbonylmethyl group; and $R^5$ is a divalent group having a number of atoms of 50 or less other than the hydrogen atoms contained in $R^5$;

(II)

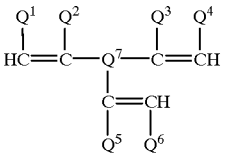

wherein $Q^1$, $Q^2$, $Q^3$, $Q^4$, $Q^5$ and $Q^6$ each represent a hydrogen atom, a halogen atom, an alkyl group, an alkoxycarbonyl group or an alkoxycarbonylmethyl group, and $Q^7$ represents a trivalent group having a number of atoms of 50 or less other than the hydrogen atoms contained in $Q^7$; and (III)

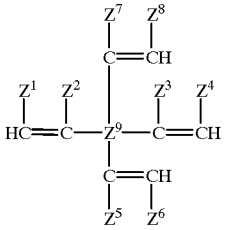

wherein $Z^1$, $Z^2$, $Z^3$, $Z^4$, $Z^5$, $Z^6$, $Z^7$ and $Z^8$ each represent a hydrogen atom, a halogen atom, an alkyl group, an alkoxycarbonyl group or an alkoxycarbonylmethyl group, and $Z^9$ represents a tetravalent group having a number of atoms of 50 or less other than the hydrogen atoms contained in $Z^9$.

27. The process according to claim 23, wherein the compound constituting the heat-sensitive recording component is a usually colorless or pale-colored electron-donative dye precursor and an electron-accepting compound which color-forms said dye precursor.

28. The process according to claim 23, wherein an isocyanate compound is contained as the compound constituting the heat-sensitive recording component.

29. The process according to claim 23, wherein the heat-sensitive recording layer contains two kinds or more of heat-sensitive recording components different in formed color tone and a color-formation controlling layer is formed on the surface of at least one of the compounds constituting said heat-sensitive recording component to control a temperature of color-formation whereby two or more kinds of color tones are developed by different heating temperatures.

30. The process according to claim 23, wherein a volume average particle size of the particle of the compound constituting the heat-sensitive recording component to which the color-formation controlling layer is formed is 0.1 μm or more to 20 μm or less.

31. The process according to claim 23, wherein a dispersing medium for dispersing the compound constituting the heat-sensitive recording component contains 50 % by weight or more of water.

32. The process according to claim 31, wherein a water-soluble polymerization initiator is used for subjecting the compound having an unsaturated carbon bond to addition polymerization.

33. The process according to claim 32, wherein the water-soluble polymerization initiator is used in an amount of 0.001% by weight or more to 10% by weight or less based on the amount of the compound having an unsaturated carbon bond.

34. The process according to claim 31, wherein the compound having an unsaturated carbon bond is a methacrylate or a mixture of a methacrylate and other compound having an unsaturated carbon bond.

35. The process according to claim 23, wherein the compound having an unsaturated carbon bond is added to a dispersion of particles of the compound constituting the heat-sensitive recording component to which the color-formation controlling layer is formed in the state of a dispersion by suspending and dispersing in a dispersing medium.

36. The process according to claim 35, wherein a suspended drop of the compound having an unsaturated carbon bond in a suspended dispersion has a volume average particle diameter of 1 μm or more to 100 μm or less.

37. The process according to claim 23, wherein the compound having an unsaturated carbon bond is added two or more times to a dispersion of particles of the compound constituting the heat-sensitive recording component to which the color-formation controlling layer is formed by dividing into two or more portions so that the color-formation controlling layer is formed on the surface of said particles by two or more times.

38. A heat-sensitive recording material having a support and provided thereon a heat-sensitive recording layer mainly comprising a heat-sensitive recording component which forms a color by heating, the improvement wherein said heat-sensitive recording component comprises two or more kinds of compounds, the heat-sensitive recording layer contains at least one of the compounds constituting said heat-sensitive recording component in the state of a particle on the surface of which is formed a color-formation controlling layer comprising a polymer of a compound having an unsaturated carbon bond, and a compound having two or more unsaturated carbon bonds is contained in the compound having an unsaturated carbon bond in an amount of 1 to 70% by weight based on the total weight of the compound having an unsaturated carbon bond.

39. The heat-sensitive recording material according to claim 38, wherein the compound having 2 or more unsaturated carbon bonds is a compound represented by the following formula (I), (II) or (III), or a mixture of at least two of these compounds or a polymerized product of at least one of these compounds:

(I)

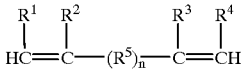

wherein n represents 0 or 1; $R^1$, $R^2$, $R^3$ and $R^4$ each represent a hydrogen atom, a halogen atom, an alkyl group, an alkoxycarbonyl group or an alkoxycarbonylmethyl group; and $R^5$ is a divalent group having a number of atoms of 50 or less other than the hydrogen atoms contained in $R^5$;

(II)

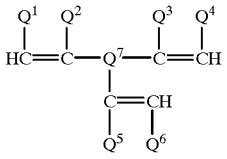

wherein $Q^1$, $Q^2$, $Q^3$, $Q^4$, $Q^5$ and $Q^6$ each represent a hydrogen atom, a halogen atom, an alkyl group, an alkoxycarbonyl group or an alkoxycarbonylmethyl group, and $Q^7$ represents a trivalent group having a number of atoms of 50 or less other than the hydrogen atoms contained in $Q^7$; and (III)

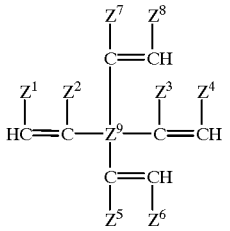

wherein $Z^1$, $Z^2$, $Z^3$, $Z^4$, $Z^5$, $Z^6$, $Z^7$ and $Z^8$ each represent a hydrogen atom, a halogen atom, an alkyl group, an alkoxycarbonyl group or an alkoxycarbonylmethyl group, and $Z^9$ represents a tetravalent group having a number of atoms of 50 or less other than the hydrogen atoms contained in $Z^9$.

40. The heat-sensitive recording material according to claim 38, wherein the compound having an unsaturated carbon bond is used in an amount of 0.5% by weight or more to 1000% by weight or less based on the particles of the compound constituting the heat-sensitive recording component to which the color-formation controlling layer is formed.

41. The heat-sensitive recording material according to claim 38, wherein the compound constituting the heat-sensitive recording component is a usually colorless or pale-colored electron-donative dye precursor and an electron-accepting compound which color-forms said dye precursor.

42. The heat-sensitive recording material according to claim 38, wherein an isocyanate compound is contained as the compound constituting the heat-sensitive recording component.

43. The heat-sensitive recording material according to claim 38, wherein the heat-sensitive recording layer contains two kinds or more of heat-sensitive recording components different in formed color tone and a color-formation controlling layer is formed on the surface of at least one of the compounds constituting said heat-sensitive recording component to control a temperature of color-formation whereby two or more kinds of color tones are developed by different heating temperatures.

44. The heat-sensitive recording material according to claim 38, wherein the color-formation controlling layer is formed by adding the compound having an unsaturated carbon bond to a dispersion of a compound constituting said heat-sensitive recording component and subjecting said compound having an unsaturated carbon bond to addition polymerization.

45. The heat-sensitive recording material according to claim 39, wherein a volume average particle size of the particle of the compound constituting the heat-sensitive recording component to which the color-formation controlling layer is formed is 0.1 $\mu$m or more to 20 $\mu$m or less.

46. The heat-sensitive recording material according to claim 40, wherein a dispersing medium for dispersing the compound constituting the heat-sensitive recording component contains 50% by weight or more of water.

47. The heat-sensitive recording material according to claim 46, wherein a water-soluble polymerization initiator is used for subjecting the compound having an unsaturated carbon bond to addition polymerization.

48. The heat-sensitive recording material according to claim 49, wherein the water-soluble polymerization initiator is used in an amount of 0.001% by weight or more to 10% by weight or less based on the amount of the compound having an unsaturated carbon bond.

49. The heat-sensitive recording material according to claim 46, wherein the compound having an unsaturated carbon bond is a methacrylate or a mixture of a methacrylate and other compound having an unsaturated carbon bond.

50. The heat-sensitive recording material according to claim 44, wherein the compound having an unsaturated carbon bond is added to a dispersion of particles of the compound constituting the heat-sensitive recording component to which the color-formation controlling layer is formed in the state of a dispersion by suspending and dispersing in a dispersing medium.

51. The heat-sensitive recording material according to claim 50, wherein a suspended drop of the compound having an unsaturated carbon bond in a suspended dispersion has a volume average particle diameter of 1 $\mu$m or more to 100 $\mu$m or less.

52. The heat-sensitive recording material according to claim 44, wherein the compound having an unsaturated carbon bond is added two or more times to a dispersion of particles of the compound constituting the heat-sensitive recording component to which the color-formation controlling layer is formed by dividing into two or more portions so that the color-formation controlling layer is formed on the surface of said particles by two or more times.

* * * * *